US007130559B2

(12) United States Patent
Kimura et al.

(10) Patent No.: US 7,130,559 B2
(45) Date of Patent: Oct. 31, 2006

(54) RECYCLING SYSTEM AND METHOD OF MANAGING REUSABLE COMPONENTS

(75) Inventors: Hiroyuki Kimura, Tokyo (JP); Masao Hayashi, Tokyo (JP); Yoichi Takaragi, Tokyo (JP); Kentaro Saito, Tokyo (JP); Hiroshi Kaburagi, Tokyo (JP); Toshikazu Sekizawa, Tokyo (JP); Akio Ito, Tokyo (JP)

(73) Assignee: Canon Kabushiki Kaisha, Tokyo (JP)

( * ) Notice: Subject to any disclaimer, the term of this patent is extended or adjusted under 35 U.S.C. 154(b) by 214 days.

(21) Appl. No.: 10/995,988

(22) Filed: Nov. 22, 2004

(65) Prior Publication Data

US 2005/0117918 A1 Jun. 2, 2005

(30) Foreign Application Priority Data

Dec. 1, 2003 (JP) ..... 2003-402204
Oct. 19, 2004 (JP) ..... 2004-304735

(51) Int. Cl.
*G03G 15/00* (2006.01)

(52) U.S. Cl. ..... 399/109; 399/8; 399/24

(58) Field of Classification Search ..... 399/8, 399/24, 109

See application file for complete search history.

(56) References Cited

U.S. PATENT DOCUMENTS

| | | | | |
|---|---|---|---|---|
| 5,127,012 | A * | 6/1992 | Hiliger | 399/8 |
| 5,216,464 | A * | 6/1993 | Kotani et al. | 399/24 |
| 2002/0028080 | A1 * | 3/2002 | Naito et al. | 399/24 |
| 2002/0059106 | A1 | 5/2002 | Tani | |
| 2005/0105934 | A1 * | 5/2005 | Maruyama et al. | 399/109 |

* cited by examiner

*Primary Examiner*—Susan Lee
(74) *Attorney, Agent, or Firm*—Canon U.S.A., Inc. Intellectual Property Division

(57) ABSTRACT

A recycling system for managing reusable units to be used in an image-forming apparatus (e.g., MFP device including units, the system comprising inputting kind information of the units), storing use information corresponding to the image-forming apparatus, and determining a reuse level of a reusable unit to be provided based on the kind information and the use information.

12 Claims, 18 Drawing Sheets

FIG. 6A 602 603 601

| USER ID | # | NAME OF PART | MODEL NO. | REUSE LEVEL | USE |
|---|---|---|---|---|---|
| XXX | 000001 | CARTRIDGE | B-078 | 7 | IMAGE QUALITY |
| IMAGE-FORMING APPARATUS ID | 000002 | ROLLER | D-119 | 9 | PERFORMANCE |
| YYY | 000003 | DRUM | C-0222 | 5 | |
| CHANGE FLAG | 000004 | SCANNER | A-181 | 10 | |
| 1 | 000005 | FAN | E-302 | 3 | |

604

FIG. 6B

USER ID : X X X IMAGE-FORMING APPARATUS ID : Y Y Y

| # | NAME OF PART | MODEL NO. | REUSE LEVEL | REQUIRED LEVEL (IMAGE QUALITY) | | REQUIRED LEVEL (PERFORMANCE) | | ORDER STATUS | DELIVERY STATUS | INSTALLATION |
|---|---|---|---|---|---|---|---|---|---|---|
| 000001 | CARTRIDGE | B-078 | 7 | ○ | 7 | | | ○ | × | × |
| 000002 | ROLLER | D-119 | 9 | ○ | 3 | ○ | 8 | × | × | × |
| 000003 | DRUM | C-0222 | 5 | ○ | 6 | | | ○ | ○ | × |
| 000004 | SCANNER | A-181 | 10 | ○ | 9 | | | × | × | × |
| 000005 | FAN | E-302 | 3 | | | ○ | 5 | ○ | × | × |

| USER ID | IMAGE-FORMING APPARATUS ID | NAME OF PART (ID) |
|---|---|---|
| XXX | YYY | DRUM |

FIG. 11

| L | Lt |
|---|---|
| 10 | Lt<5000 |
| 9 | 5000≦Lt<10000 |
| 8 | 10000≦Lt<15000 |
| 7 | 15000≦Lt<20000 |
| 6 | 20000≦Lt<30000 |
| 5 | 30000≦Lt<50000 |
| 4 | 50000≦Lt<80000 |
| 3 | 80000≦Lt<100000 |
| 2 | 100000≦Lt<300000 |
| 1 | 300000≦Lt<500000 |

FIG. 13

| # | DEVICE ID NO | NAME OF PART | MODEL NO. | POSITION | REUSE LEVEL | LIFE (month) | ORDER STATUS | DELIVERY STATUS | INSTALLATION |
|---|---|---|---|---|---|---|---|---|---|
| 000001 | SO211i | CARTRIDGE | B-078 | C320-B2 | 7 | 4 | ○ | × | × |
| 000002 | SO211i | ROLLER | D-119 | C320-E5 | 9 | 30 | × | × | × |
| 000003 | SO211i | DRUM | C-0222 | C320-B2 | 10 | 12 | ○ | ○ | ○ |
| 000004 | SO211i | SCANNER | A-181 | C320-A1 | 6 | 25 | ○ | ○ | × |
| 000005 | SO211i | FAN | E-302 | C-320C5 | 3 | 36 | × | × | × |
| 000006 | SO211i | CASSETTE | F115 | C320-F8 | 9 | 72 | ○ | × | × |

| RECYCLE LEVEL : L | LIFE K (month) |
|---|---|
| 10 | 48≦K |
| 9 | 36≦K<48 |
| 8 | 30≦K<36 |
| 7 | 24≦K<30 |
| 6 | 18≦K<24 |
| 5 | 12≦K<18 |
| 4 | 9≦K<12 |
| 3 | 6≦K<9 |
| 2 | 3≦K<6 |
| 1 | 1≦K<3 |

RECYCLING SYSTEM AND METHOD OF MANAGING REUSABLE COMPONENTS

BACKGROUND OF THE INVENTION

1. Field of the Invention

The present invention relates to a system for efficiently using recyclable/reusable parts in an image-forming apparatus in accordance with the characteristics of parts included in the image-forming apparatus.

2. Description of the Related Art

Japanese Patent Laid-Open No. 2002-31988 discloses "a consumable-item-providing system for delivering a consumable item or a recycled consumable item that is recycled for about the same number of times as the consumable item".

However, known systems similar to that disclosed in the above-described publication are applied for recycling only process cartridges, and are not capable of collectively managing multiple recyclable parts included in image-forming apparatuses. More specifically, although a typical image-forming apparatus includes various units having individual specific characteristics, no system for efficiently using recyclable/reusable items in accordance with the characteristics of the units has been suggested.

In addition, although the image-forming apparatus is used for various uses, no system for efficiently managing the recyclable/reusable items while satisfying requirements based on the use of the image-forming apparatus has been suggested.

SUMMARY OF THE INVENTION

Accordingly, the present invention is directed to an information processor, an information processing method, and a program which overcome the above-described disadvantages. More specifically, the present invention is directed to a system for collectively managing recyclable parts for use in an image-forming apparatus including units having individual specific characteristics. The present invention is also directed to a system for efficiently using recyclable/reusable items while satisfying requirements based on the use of the image-forming apparatus, which varies depending on the user. In addition, the present invention is also directed to a system for collectively managing recyclable/reusable parts such that the remaining lives of parts (components) included in the image-forming apparatus are made uniform when the units having individual specific characteristics are replaced.

Accordingly, the present invention is conceived as a response to the above-described disadvantages of the conventional art.

According to one aspect of the present invention, a recycling system includes an identifier which identifies the kind of a unit and a determiner which selects a unit having a predetermined reuse level on the basis of the kind of the unit identified by the identifier and the use of an image-forming apparatus in which the unit is used.

Since the kind of the unit is identified and a unit having the predetermined reuse level is provided on the basis of the kind of the unit, recyclable/reusable items can be used efficiently.

Other features and advantages of the present invention will be apparent from the following description taken in conjunction with the accompanying drawings, in which like reference characters designate the same or similar parts throughout the figures there.

BRIEF DESCRIPTION OF THE DRAWINGS

FIGS. 6A and 6B are tables showing order lists of the recyclable parts.

FIG. 11 is a table showing the relationship between the recycle value Lt and the reuse level L.

FIG. 13 is a table showing information of recyclable parts stored in a database.

DETAILED DESCRIPTION OF THE INVENTION

An exemplary embodiment of the present invention will now be described in detail with reference to the drawings. It should be noted that the relative arrangement of the components, the numerical expressions and numerical values set forth in these embodiments do not limit the scope of the present invention unless it is specifically stated otherwise.

First Embodiment

Figure 1:
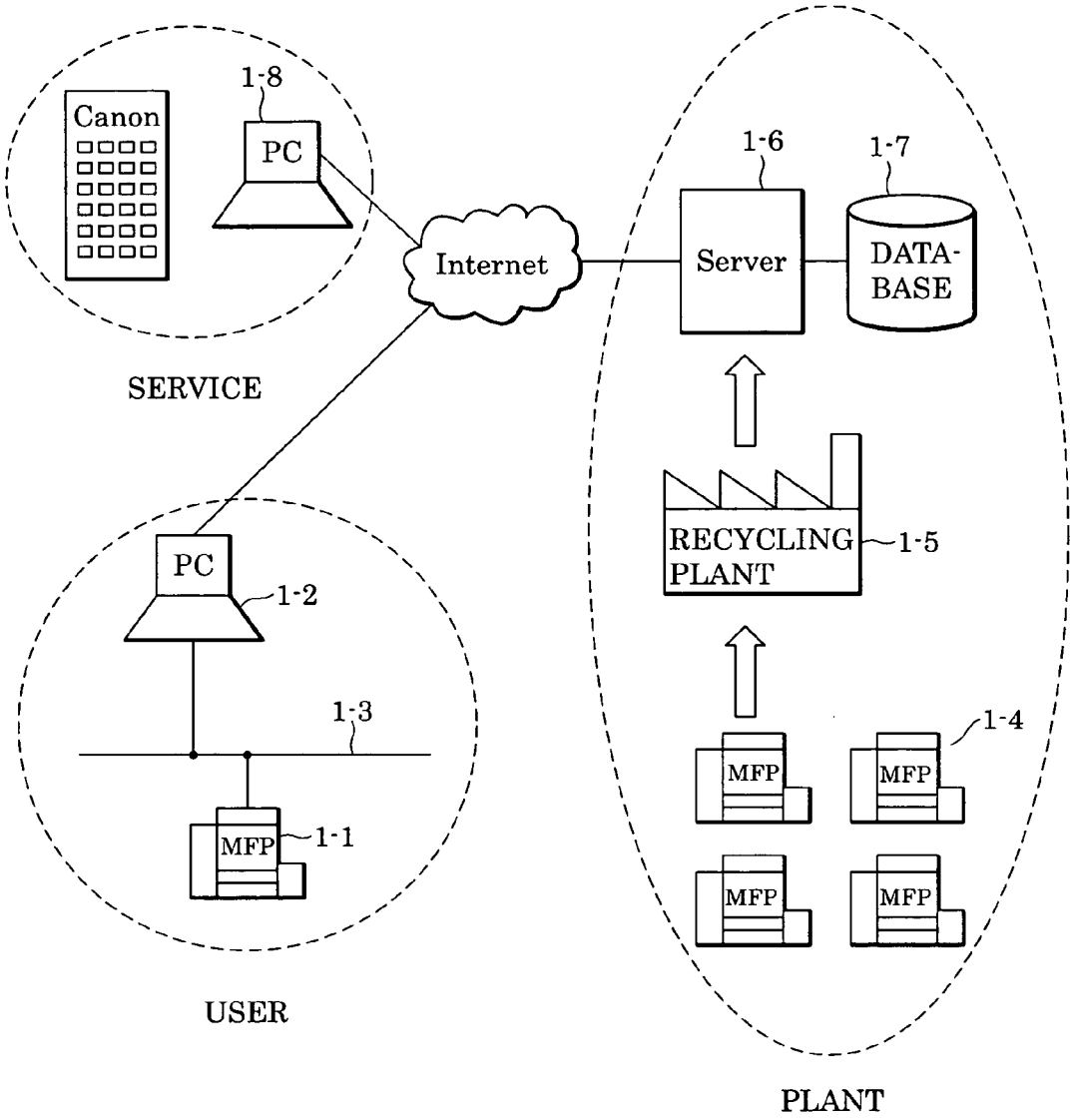
FIG. 1 is a diagram showing the overall system according to embodiments of the present invention.

With reference to FIG. 1, a multifunction peripheral (MFP) device 1-1 is an image-forming apparatus which performs monochrome scanning/printing or low-resolution or binary color scanning/printing. The present invention will be described with reference to the MFP device 1-1. However, the present invention may also be applied to any image-forming apparatus, like single function printers which do not have a scanning function, such as ink-jet printers, etc. In addition, the MFP device 1-1 may also be a full-color device which performs high-resolution, high-gradation, full-color scanning/printing. However, the difference between a monochrome MFP device and a color MFP device is whether scanning/printing is performed in full color or monochrome, and the full-color device often comprises the structure of the monochrome devices in addition to a unit for performing color processing. Accordingly, a full-color device will be mainly described below, and explanations regarding a monochrome device will be added as necessary.

1. Internal Structure of MFP Device 1-1

Figure 2:
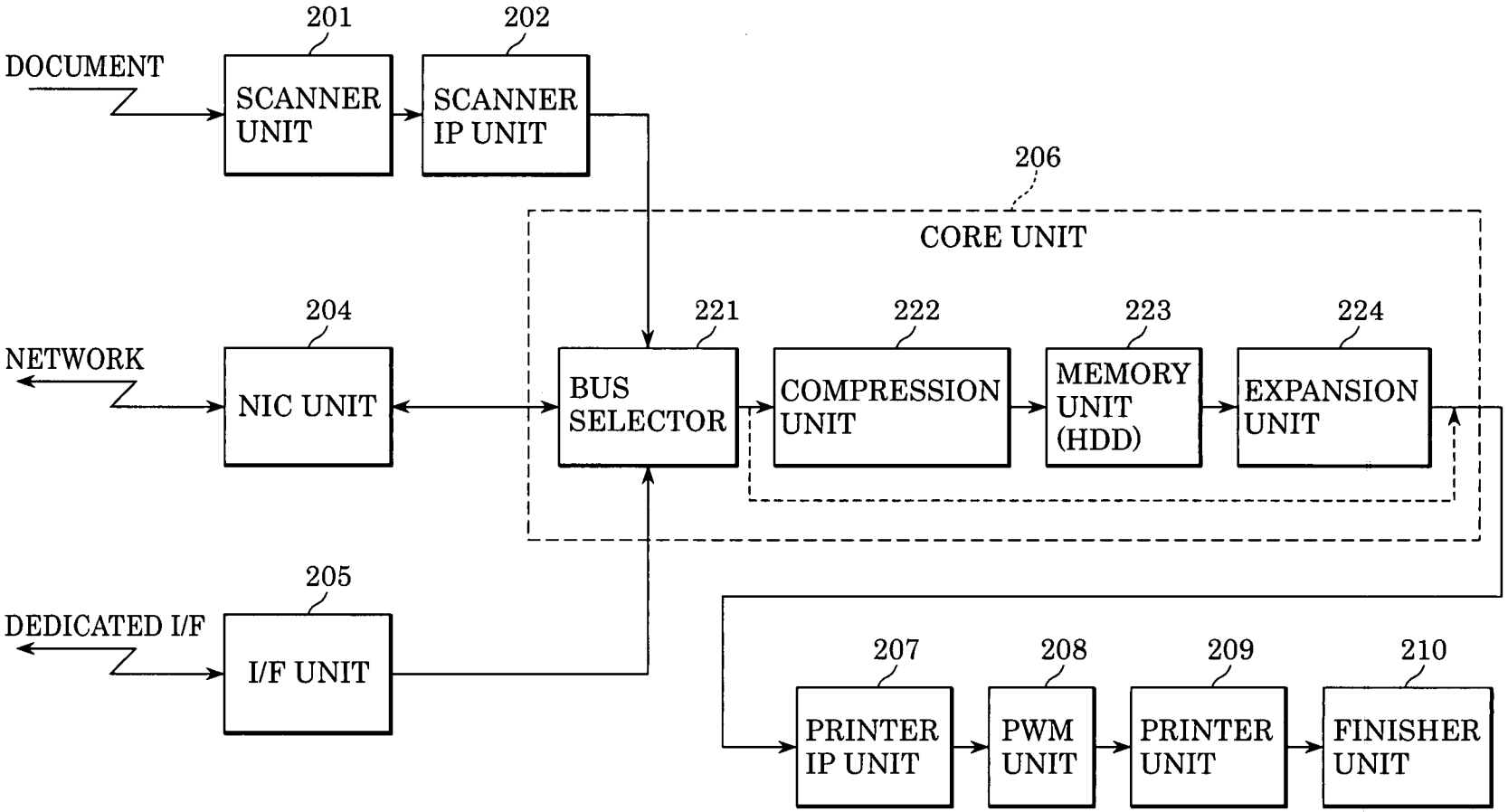
FIG. 2 is a block diagram showing the overall structure of an image-forming apparatus.

As shown in FIG. 2, the MFP device 1-1 includes a scanner unit 201 for reading an image, a scanner IP unit 202 for processing image data obtained by the scanner unit 201, a network interface card (NIC) unit 204 for communicating the image data, information regarding the device, various statuses of the device, etc., via a network, and a dedicated interface (I/F) unit 205 for exchanging information with the MFP device 1-1. A core unit 206 temporarily stores an image signal or determines a path thereof depending on the use of the MFP device 1-1.

The image data is output from the core unit 206 and is supplied to a printer unit 209, which forms (records) images, via a printer IP unit 207 and a pulse width modulation (PWM) unit 208. The printer unit 209 prints images on recording medium, and the recording medium are conveyed to a finisher unit 210 which performs sorting, finishing, etc., of the recording medium.

The MFP device 1-1 further includes a central processing unit (CPU) 47 which functions as a control unit for controlling the overall operation of the MFP device 1-1, a display (operation screen) (not shown) through which a user inputs information for operating the MFP device 1-1 and which displays various information, and a display controller (not shown). The CPU 47 controls components, such as the above-mentioned units, of the MFP device 1-1 on the basis of the information input by a user through the operation screen.

2. Structure of Scanner Unit 201

Figure 3:
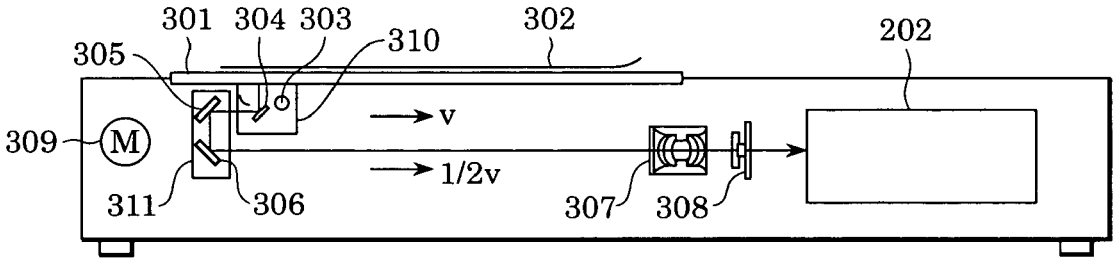
FIG. 3 is a diagram showing a scanner unit included in the image-forming apparatus.

The structure of the scanner unit 201 will be described below with reference to FIG. 3. An original document 302 to be scanned is placed on a document table glass 301 and is illuminated by an illuminating lamp 303. The light reflected by the original document 302 is guided by mirrors 304, 305, and 306 through a lens 307 to form an image on a charge-coupled device (CCD) 308. A first mirror unit 310 includes the mirror 304 and the illuminating lamp 303 and moves at a speed v. A second mirror unit 311 includes the mirrors 305 and 306 and moves at a speed of ½v, so that the entire surface of the original document 302 is scanned. The first mirror unit 310 and the second mirror unit 311 are driven by a motor 309.

3. Structure of Printer Unit 209 (in Color MFP Device)

Figure 4:
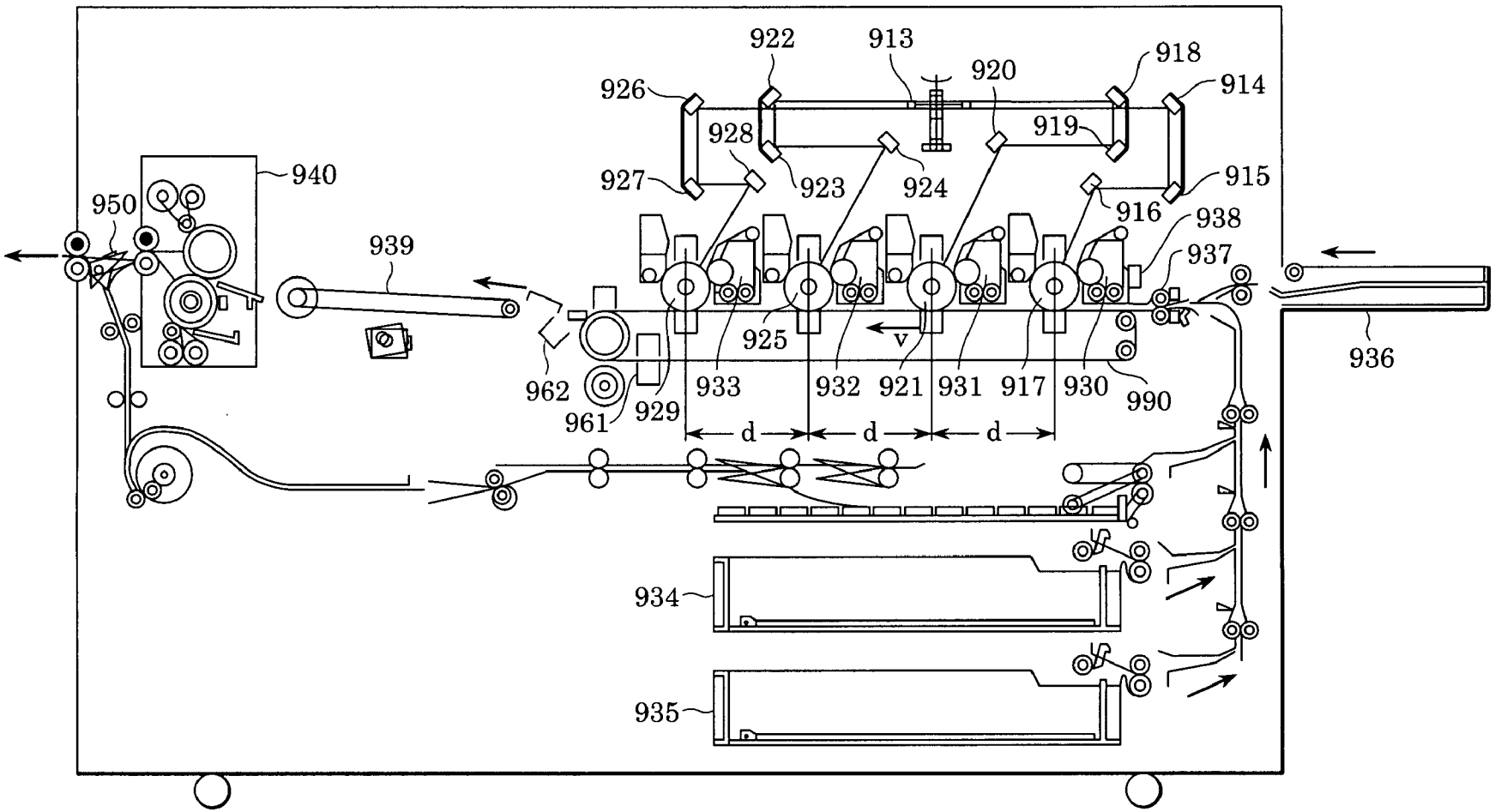
FIG. 4 is a diagram showing a printer unit included in the image-forming apparatus.

FIG. 4 shows a schematic view of the printer unit 209 which performs color printing. A polygon mirror 913 receives four laser beams emitted from four respective semiconductor lasers: a first laser beam for scanning a photosensitive drum 917 via mirrors 914, 915, and 916; a second laser beam for scanning a photosensitive drum 921 via mirrors 918, 919, and 920; a third laser beam for scanning a photosensitive drum 925 via mirrors 922, 923, and 924; and a fourth laser beam for scanning a photosensitive drum 929 via mirrors 926, 927, and 928.

A developer 930 supplies yellow (Y) toner for forming a yellow toner image on the photosensitive drum 917 in accordance with the first laser beam. A developer 931 supplies magenta (M) toner for forming a magenta toner image on the photosensitive drum 921 in accordance with the second laser beam. A developer 932 supplies cyan (C) toner for forming a cyan toner image on the photosensitive drum 925 in accordance with the third laser beam. A developer 933 supplies black (K) toner for forming a black toner image on the photosensitive drum 929 in accordance with the fourth laser beam. The toner images of four colors (Y, M, C, and K) are transferred onto a recording medium, and a full-color image is thus formed on the recording medium.

The recording medium is fed from one of recording medium cassettes 934 and 935 or from a manual feed tray 936, then conveyed between resister rollers 937, and is adhered to a transfer belt 938, which carries the recording medium. The toner images of four colors are respectively formed on the photosensitive drums 917, 921, 925, and 929 in synchronization with the time at which the recording medium is fed, and are successively transferred onto the recording medium as the recording medium is carried. The recording medium onto which the toner images of four colors are transferred is separated from the transfer belt and is conveyed by a conveyor belt 939 to a fixing unit 940, where the toner is fixed on the recording medium. When the recording medium exits the fixing unit 940, it is guided downward by a flapper 950, and is then pulled upward and discharged after the back end of the recording medium is moved to below the flapper 950. Accordingly, the recording medium is output with the printed side facing down, and thus a document having a plurality of pages can be printed in the correct order.

The four photosensitive drums 917, 921, 925, and 929 are positioned with a constant distance d therebetween, and the recording medium is conveyed by a conveyor belt 990 at a constant speed v. The four semiconductor lasers are driven in synchronization with the recording medium being conveyed, and accordingly an image is recorded on a predetermined recording medium, such as a sheet of paper, an overhead projector (OHP) sheet, etc.

4. Reusable (Recyclable) Part Management System

FIG. 1 is a schematic diagram showing a reusable part management system. A user environment includes communication lines (hereafter called a network 1-3) to which the MFP device 1-1 and an information processor (hereafter called a PC 1-2) are connected. In the user environment, in order to prevent leakage of information regarding various components included in the MFP device 1-1, the PC 1-2 functions as a fire-wall server for blocking intrusion from the outside. The network 1-3 in the user environment may, also be directly connected to the Internet. In any case, information regarding parts, particularly consumable and recyclable parts, included in the MFP device 1-1 can be transmitted via the Internet or by other communication means, for example, a modem.

A recycling plant environment is also connected to the Internet, and is provided with an information processor (hereafter called a management server 1-6) which manages information regarding recyclable parts and a database 1-7 which stores the information, and which the user's PC 1-2 and other external devices can access. In addition, discarded MFP devices 1-4 are collected and disassembled in a recycling plant 1-5, and parts are sorted into recyclable and non-recyclable groups. Then, a reuse level is determined for each recyclable part using a method described below, and information regarding the recyclable parts is stored in the database 1-7. The MFP devices 1-4 are collected from user environments, and include a device whose information had been constantly updated in the database 1-7 by a process described below. Accordingly, the database 1-7 stores the information of some MFP devices 1-4 and parts thereof before the MFP devices 1-4 are collected at the recycling plant 1-5, and the information of other MFP devices 1-4 which are newly registered in the database 1-7 is additionally stored in the database 1-7.

A service company environment is also connected to the Internet and is provided with a PC 1-8. In known systems, the states of consumable items used in the user environment are monitored via the Internet. When the amounts of remaining consumable items become small, the service company accesses the MFP device 1-1, a management server (not shown) in the user environment, or the PC 1-2 which stores the information of the MFP device 1-1. Alternatively, a management server (not shown) or the PC 1-8 in the service company automatically orders the consumable items.

The present invention is characterized in that not only the states of the consumable items, but also the states of recyclable parts are monitored via the Internet. More specifically, in addition to monitoring the levels of consumption of the consumable items as in known systems, reuse levels of the recyclable parts are also monitored. When there is a recyclable part to be replaced, automatic ordering of the recyclable part is carried out similarly to that of the consumable items. The information of the recyclable parts included in the MFP device 1-1 in the user environment is registered and managed by the management server 1-6 in the recycling plant. The information of the recyclable parts included in the MFP device 1-1 in the user environment may, also be managed by the PC 1-8 in the service company. For simplicity, a case is considered in which the management server 1-6 in the recycling plant manages the information of the recyclable parts included in the MFP device 1-1 in the user environment. Since the management server 1-6 manages the information regarding the MFP device 1-1, if the MFP device 1-1 is rented or leased, the date on which it will be collected at the recycling plant can be identified.

As described above, according to the present invention, the user environment, the recycling plant environment, and the service company environment communicate information regarding the recyclable parts with one another via the Internet, and accordingly, the parts are distributed efficiently.

Although only one management server 1-6 is shown, the reusable (recyclable) part management system may also include a plurality of information processors if they can logically provide a management server function as described below. In addition, although the PC 1-8 in the service company is independent of the management server 1-6, the reusable (recyclable) part management system can include only one information processor. In addition, although the MFP device 1-1 and the PC 1-2 are independent devices, they can be combined into a single device.

5. Determination of Levels of Recyclable Parts

Although various level-determining methods are known, a method for determining a reuse level of, for example, a process toner cartridge and a fan motor will be described below.

Figure 10:
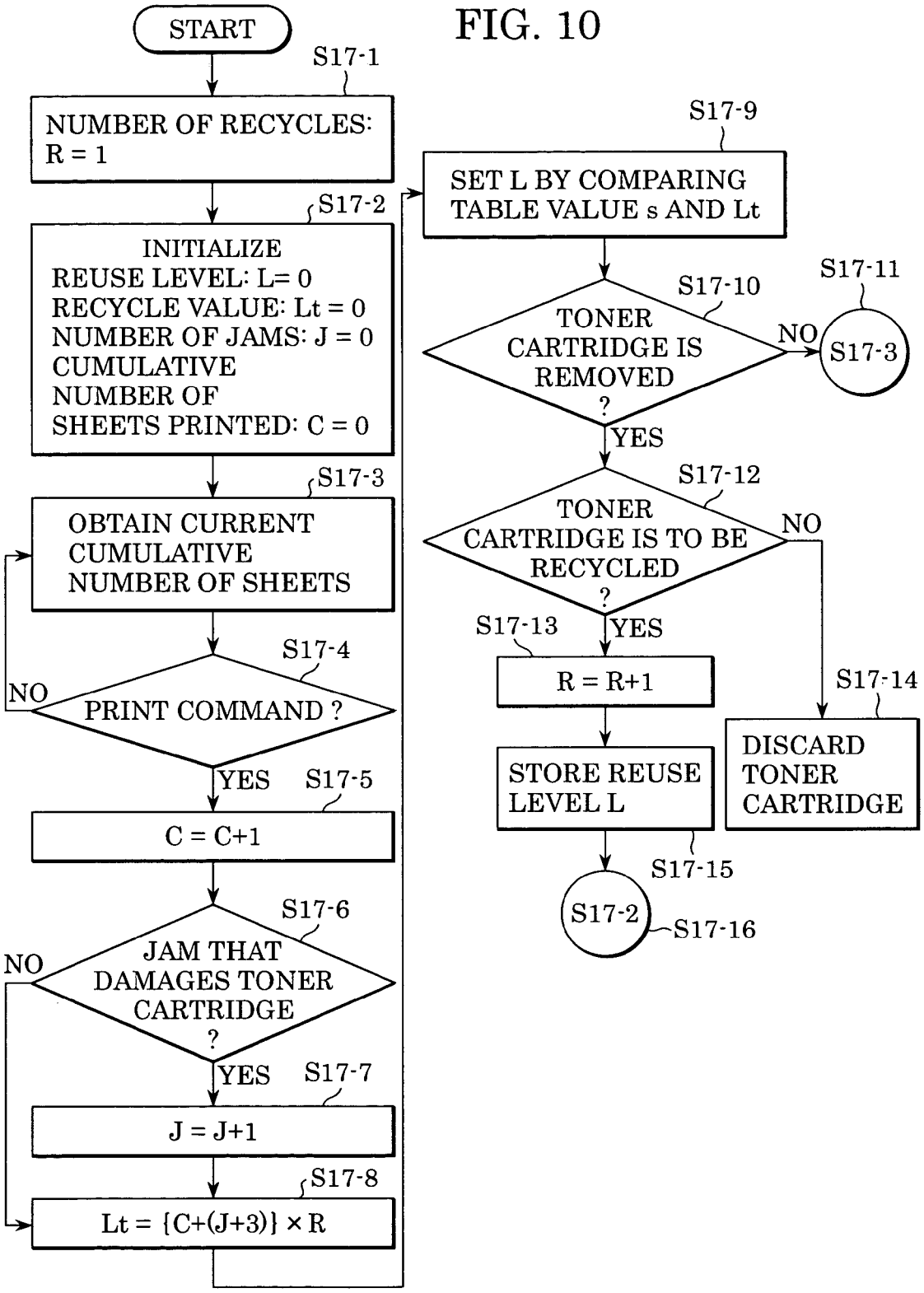
FIG. 10 is a flowchart of a process for calculating a reuse level.

Referring to FIG. 10, steps S17-3 to S17-11 are executed by a program (i.e., computer-executable process steps) stored in a memory, such as a system memory, by the CPU 47 included in the MFP device 1-1. Steps S17-1, S17-2, and S17-12 to S17-16 are executed by a management unit (e.g., a computer such as a management server 1-6) installed in the recycling plant.

As shown in FIG. 10, in step S17-1, in the case of a process toner cartridge, the initial value for the number of recycles R is set to 1 (R=1) in a radio frequency identification (RFID) tag (nonvolatile memory) attached to the cartridge. This means that the cartridge is new and has never been recycled, and '1' is input since it is used for the first time. The number of recycles R is incremented when the part is recycled in the recycling plant.

In step S17-2, the reuse level L is determined on the scale of 1 to 10, and L is set to an initial value of 0 (L=0). In addition, a recycle value Lt for temporarily memorizing a calculation result to determine the reuse level is set to an initial value of 0 (Lt=0). The cumulative number C of recording media printed using the process toner cartridge and the number of jams J that has damaged the process toner cartridge are both set to 0 as initial values (C=0 and J=0).

Then, in step S17-3, the current cumulative number of recording media printed is read from the nonvolatile memory attached to the process toner cartridge. This value is not initiated, even when the cartridge is recycled, and the number of recording medium printed in total is counted continuously. Next, in step S17-4, it is determined whether a print command is issued. If the print command is not issued, then the process returns to step S17-3. If the print command is issued, the process toner cartridge is used, and accordingly the cumulative number of sheets printed is incremented (C=C+1) in step S17-5.

Next, in step S17-6, a check is made whether a jam occurs at a position such that the process toner cartridge is damaged. If it is determined that such a jam did not occur, flow proceeds to step S17-8. If it is determined that such a jam did occur, flow proceeds to step S17-7, where the number of jams J is incremented (J=J+1). The number of jams J represents the number of times such a jam has occurred since the time of recycle or since the start of use if the process toner cartridge is new.

In step S17-8, the recycle value Lt, which is an intermediate value for determining the reuse level, is calculated as follows:

$$\text{Recycle Value } Lt=[(\text{Cumulative Number of Sheets})+(\text{Number of Jams after Reuse})\times 3]\times(\text{Number of Reuses}) \quad (1)$$

Various factors are taken into account to obtain the above equation, and accordingly the equation is derived from experiment and experience. It is, necessary to determine the level of the recyclable part from an overall point of view by also taking into account the life of the process toner cartridge, which varies depending on the degradation of a resin container of the process toner cartridge. For simplicity, it is presumed that the above equation is derived from experiment and experience.

As described above, when it is determined in step S17-6 that no jam has occurred at a position such that the process toner cartridge is damaged, the recycle value Lt is calculated from the equation used in step S17-8 without incrementing the number of jams. Next, in step S17-9, a table, as shown in FIG. 11, which shows the relationship between the calculated recycle value Lt and values obtained from experiment and experience, the table being stored in the memory included in the image-forming apparatus, is referred to. This table may either be fixed or be changed by feedback. The reuse level L is determined by comparing the recycle value Lt with predetermined thresholds included in the table. The relationship between the reuse level L and the recycle value Lt is also derived from experiment and experience.

In the table shown in FIG. 11, the degree of degradation decreases as the reuse level L increases. For example, when the recycle value is determined as Lt=2500 from Equation (1), the reuse level L is 10 (L=10), which means that the degree of degradation of the recyclable part is low. Similarly, when the recycle value is determined as Lt=102000, the reuse level is 2, which means that the degree of degradation of the recyclable part is high. In step S17-9, the reuse level L is determined from the table shown in FIG. 11 and is stored in the nonvolatile memory.

Following step S17-9, in step S17-10, a check is performed whether the toner cartridge has been removed from the image-forming apparatus. If the toner cartridge has not been removed, then in step S17-11, the process returns to step S17-3. In addition, the process also returns to step S17-3 when the toner cartridge is placed back into the image-forming apparatus after it was temporarily removed.

When the toner cartridge is removed and not placed back into the image-forming apparatus, in step S17-12, it is determined whether the toner cartridge is to be recycled in the recycling plant 1-5. If it is determined that the toner cartridge is not to be recycled from the reuse level L, flow proceeds to step S17-14, where the toner cartridge is discarded. If it is determined that the toner cartridge is to be recycled, flow proceeds to step S17-13, the number of reuses R stored in the nonvolatile memory is incremented after the toner cartridge is recycled in the recycling plant. Then, in step S17-15, the reuse level L is stored in the database 1-7 in the recycling plant, along with an identification number of the recycled part. In addition, in the recycling plant, data items stored in the nonvolatile memory attached to the recycled part are reset to 0, except for the number of reuses R. In step S17-16, flow then returns to step S17-12.

The flowchart of FIG. 10 is also used for a fan motor, and the accuracy of determination of the reuse level can be increased by taking into account not only the number of jams but also the rotational speed of the fan motor, which most affects the life of the fan motor, the cumulative on-time, and the position of installation as the factors for determining the reuse level. The position of installation is taken into account because a lubricant of a motor shaft is easily degraded when the motor shaft touches toner or is used in severe environments, such as high-temperature high-humidity environments. The parts used in the image-forming apparatus have different individual characteristics, and the reuse level must be determined in accordance with the characteristics of each part. Accordingly, the reuse levels of the parts are determined using thresholds derived from experiment and experience individually for each part.

6. Central Management of Recyclable Parts Using CPU in MFP Device

Figure 9:
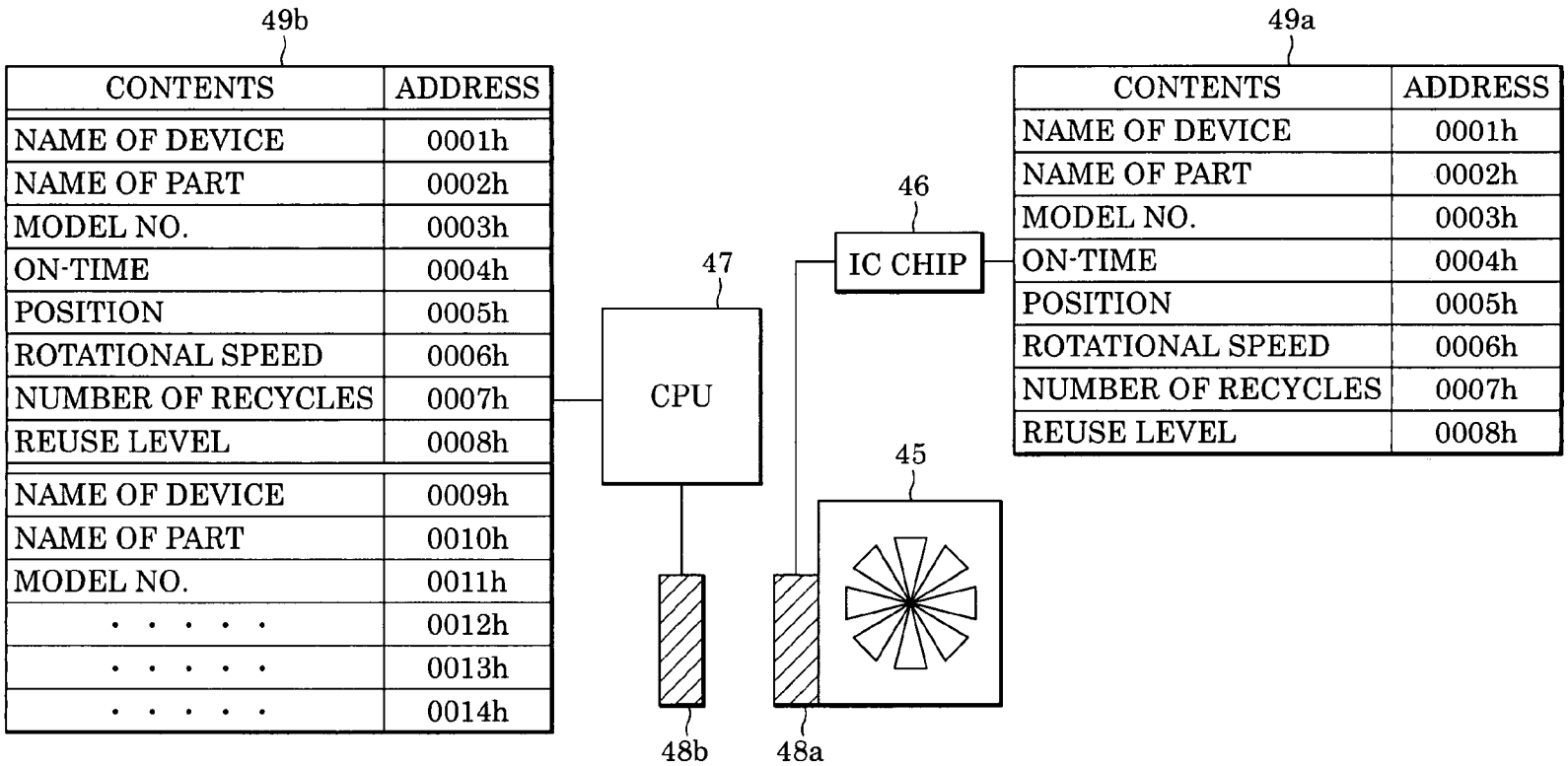
FIG. 9 is a schematic diagram showing a system for managing information of each recyclable part.

FIG. 9 is a schematic diagram showing a system in which a CPU 47 manages information of each of the recyclable parts included in the image-forming apparatus. The CPU 47, which is included in the MFP device 1-1, reads data from an IC chip 46 via wireless chips 48*a* and 48*b* to determine the reuse level of a fan 45, which is one of the recyclable parts in the MFP device 1-1, from the information thereof, and stores the obtained data into a memory 49*b*. Although the information of the fan 45 may also be transmitted to the CPU 47 via wires, wireless communication is applied in the present embodiment since the task can be reduced in the process of, for example, measuring the lives of the recyclable parts, which will be described below.

The information of the IC chip 46 consists of data stored in a memory 49*a* in advance of when the part was installed in the image-forming apparatus. More specifically, the memory 49*a* stores, for example, the name of the apparatus being used at address 0001, the name of the part at address 0002, and the model No. of the part at address 0003. In addition, the cumulative on-time since the fan was installed in the apparatus is stored at address 0004 because the on-time may serve as a factor for determining the life of the fan. Information including the temperature and humidity is stored at address 0005 as the environment information of the fan because the life of the fan varies depending on the installation position of the fan. The information representing the rotational speed of the fan is stored at address 0006 because the life of the fan varies depending on the percentage of the rotational speed of the fan relative to the maximum rotational speed. The number of recycles, which is initially set to 0, and is incremented each time the fan is recycled, is stored at address 0007. The information stored at addresses 0001 to 0007 is copied to the memory 49*b* (at addresses 0001 to 0007 in this case) via the wireless chips 48*a* and 48*b* as fan information, and the CPU 47 calculates the reuse level on the basis of the information stored at addresses 0001 to 0007 using the above-described reuse-level calculating method. The calculated reuse level is stored at address 0008.

The value stored at address 0008 in the memory 49*b* is copied to the memory 49*a* at address 0008 in the memory 49*a*. Thus, the information of the fan is stored in the main body of the image-forming apparatus. The reuse level may also be obtained by communicating the information between the CPU 47 and the memory 49*a* and be stored at address 0008 in the memory 49*a*. However, in such a case, the information of the fan cannot be obtained in the MFP device 1-1 once the fan is taken out from the image-forming apparatus. Therefore, the main body of the MFP device 1-1 stores the information regarding each of the recyclable parts in the memory 49*b*.

An RFID tag having a wireless communication function and a memory function (IC chip) is attached to each of the recyclable parts in advance. An RFID reader transmits a radio wave (charge wave) to the RFID tag composed of a small loop antenna and a complementary metal-oxide semiconductor (CMOS) chip including a memory and a communication circuit, and thereby supplies energy required for responding thereto. The RFID tag receives electric power based on the principle of electromagnetic induction and transmits the data. After the reader transmits the radio wave, the state of the reader is changed to a receiving state, so that the reader can receive the data from the RFID tag and transmit it to a host or write data to the RFID tag.

As described above, the information stored in memories, such as the memory 49*a*, may be transmitted from the PC 1-2 via the network as recycling information of the parts included in the MFP device 1-1 in the user environment, or be collected and stored in the service company or the recycling plant to determine the state of the MFP device 1-1. Accordingly, the service company can prevent problems before a malfunction occurs in the MFP device 1-1 by replacing parts as necessary using the above information. In addition, when the MFP device 1-1 is replaced by a new one, the recycling plant can obtain the information of the recyclable parts via the Internet and store it in the database 1-7 before the MFP device 1-1 is disassembled in the recycling plant. Therefore, the situation of a time consuming disassembly of an image-forming apparatus which does not contain a recyclable part can be avoided, thus reducing the task of recycling. In addition, when a stand-alone MFP device which is not connected to the network is disassembled, the recycling information of parts included in the apparatus may be read from memories similar to the memory 49*a*, and be displayed on an operation unit so that unnecessary disassembling can be avoided. Also in this case, the information of each part in the stand-alone MFP device may be transmitted and registered to the database 1-7. Thus, the database 1-7 stores the information of units before they are collected.

7. Registration to Database

Next, a system for registering the information of the recycled parts in a recycled-part database 1-7 is described below with reference to FIG. 8. The manner in which the information is registered is shown below in Table 1. The system shown in FIG. 8 includes an identifier for identifying the kind of a unit and a provider for providing a unit of a predetermined reuse level on the basis of the kind of the unit identified by the identifier and the use of an image-forming apparatus in which the unit is used.

Figure 8:
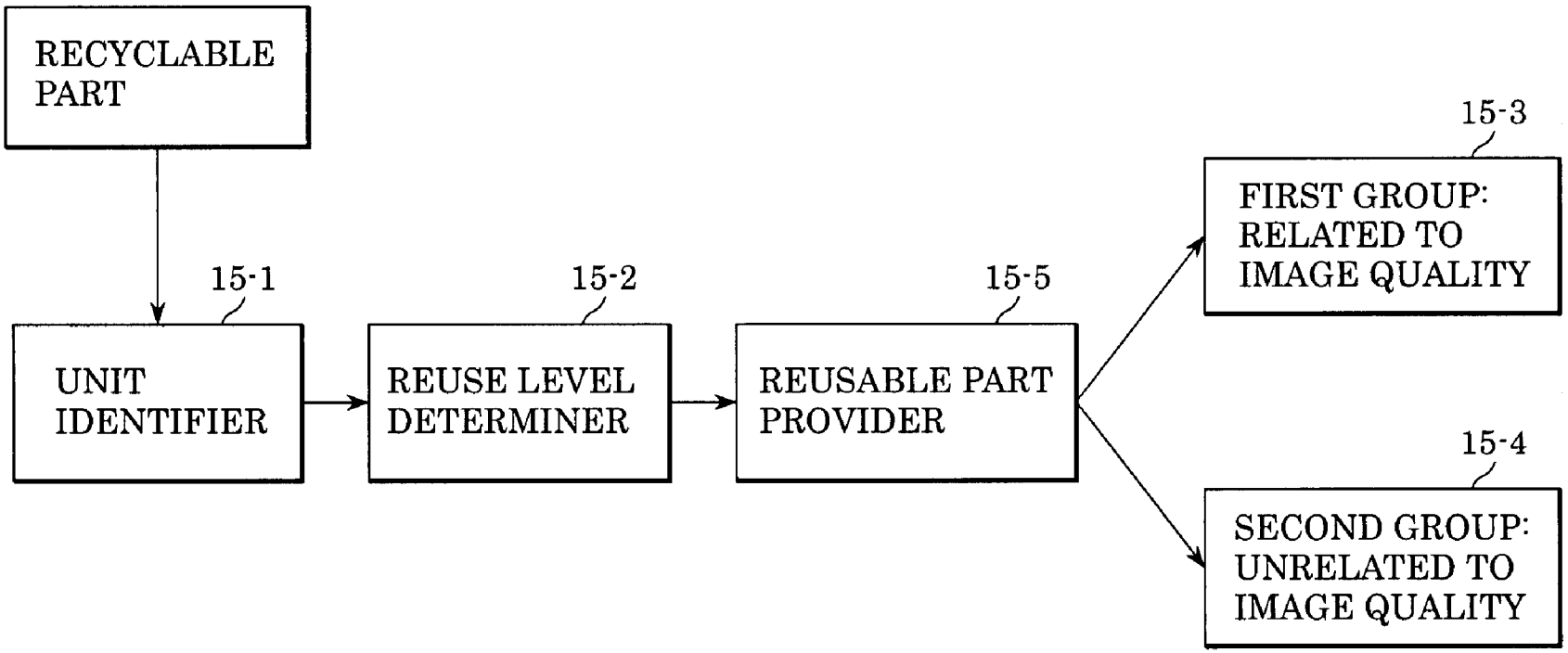
FIG. 8 is a block diagram of a recyclable-part provider according to the present invention.

A computer which functions as the management server 1-6 in the recycling plant performs each of the functions shown in FIG. 8. When the levels of reusable parts included in an image-forming apparatus which is disassembled in the recycling plant are determined, first, a unit identifier 15-1 reads information of each of the reusable parts from the RFID tag attached to the part. Then, a reuse-level determiner 15-2 determines the reuse level of each of the reusable parts by the above-described reuse-level determining method. The kind and the reuse level of each reusable part are registered in the database 1-7 connected to the management server 1-6 in the recycling plant as necessary. Accordingly, the database 1-7 stores the data regarding the kind of each unit and the reuse level corresponding thereto.

Next, a reusable part provider 15-5 checks requirements on the image-forming apparatus that are set in advance by a user. Based on these requirements, the reusable part provider 15-5 selects from either a first group 15-3, which includes parts related to image quality or a second group 15-4, which includes parts unrelated to image quality. For example, when the user defined requirements are such that the image quality is emphasized, the first group 15-3 is selected by the reusable part provider 15-5. Since, in this example, the user emphasizes the image quality, recycled parts with high reuse levels are selected for parts belonging to the first group 15-3, and if no such part is available, a new part is provided. More specifically, the reusable part provider 15-5 checks the kind and use of the unit to be replaced, and provides a new unit of the same kind if the unit belongs to the first group 15-3 and a reusable unit of the same kind if the unit belongs to the second group 15-4.

In addition, in this example, although the user emphasizes the image quality, no importance is placed on factors other than the image quality. Therefore, when the unit to be replaced is unrelated to the image quality, the reusable part provider 15-5 provides a part with low reuse level. Accordingly, a satisfactory balance between the cost and the quality can be provided by prompting the user to input and confirm the requirements on the image-forming apparatus. Thus, new parts or recycled parts with high reuse levels, which are expensive, are selected only for parts related to the image quality, which is emphasized by the user, and recycled parts with low reuse levels, which are inexpensive, are selected for parts unrelated to the image quality. The parts of the first group include, but are not limited to, a scanner, a process cartridge, a fixing device, etc., and the parts of the second group include, but are not limited to, a fan motor, a cassette, etc. Parts for replacing them are, of course, also selected by a similar flow.

8. Supply of Reusable Parts

Next, a system for automatically transferring recycled parts to the user environment will be described below with reference to FIGS. 5 to 7.

8-1. Ordering of Recycled Parts for MFP Device

Figure 5:
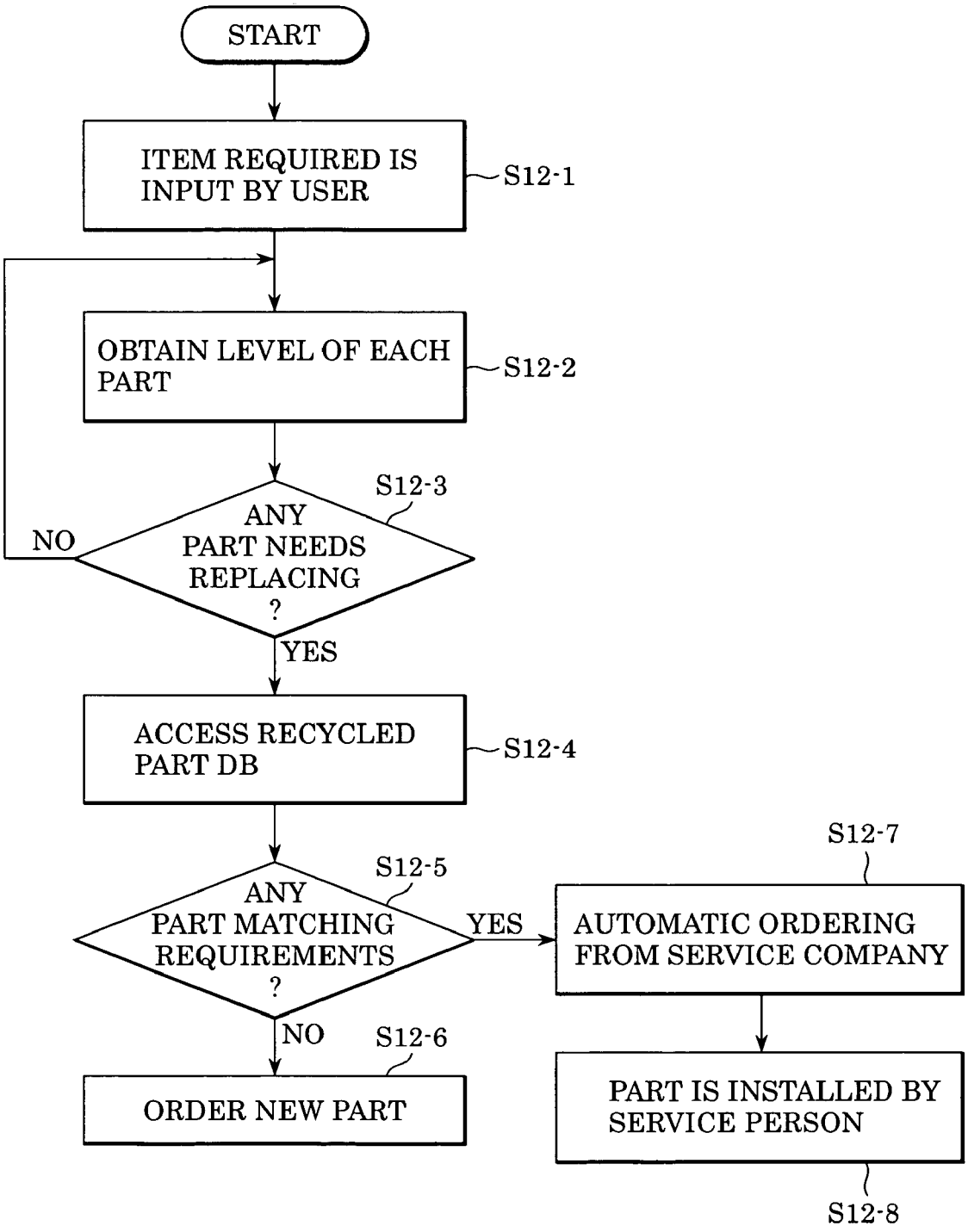
FIG. 5 is a flowchart of a process for ordering recycled parts for an MFP device in a user environment.

FIG. 5 is a flowchart of a process for ordering recycled parts for the MFP device 1-1 installed in the user environment. In the figure, steps S12-1 to S12-7 are carried out by executing a program stored in a memory, such as a system memory, with the CPU 47 included in the MFP device 1-1. Accordingly, the MFP device 1-1 is provided with an information processor including an evaluating unit for evaluating whether of not there is a unit with a reuse level reduced to below a predetermined level in the MFP device 1-1, the predetermined level corresponding to the use of the MFP 1-1, and an ordering unit for performing an ordering process on the basis of the result of determination performed by the evaluating unit.

Turning to FIG. 5, in step S12-1, the user inputs an item required of the MFP device 1-1 installed in the user environment thorough the operation screen of the MFP device 1-1. According to the present invention, this item is selected from among, for example, the image quality, the performance, the cost, etc. More than one item may be selected. The item selected by the user represents the factor emphasized by the user of the MFP device 1-1 in which recycled parts are used. For example, when image quality is selected, this typically means that the user requires high image quality from the MFP device 1-1. Therefore, when parts related to the image quality are replaced, new parts or recycled parts with high levels are ordered. Similarly, when the user selects the performance, it means that the user requires high performance. Therefore, when parts related to a production speed are replaced, new parts or recycled parts with high levels are ordered. When the user selects the cost, it means that the user wishes to keep the total cost, including running and maintenance costs, low. Therefore, inexpensive recycled parts are ordered irrespective of the levels thereof. Accordingly, the MFP device 1-1 includes an input unit with which the user inputs the use of the MFP device 1-1, and the above-described provider provides a unit of a reuse level determined on the basis of the use of the MFP device 1-1 input through the input unit and the kind of the unit to be replaced.

Next, in step S12-2, the information of recyclable parts of the MFP device 1-1, including the reuse level of each part, is updated and stored in the MFP device 1-1.

When the information is updated in step S12-2, the information is also transmitted to the PC 1-8 in the service company and the management server 1-6 in the recycling plant via the network. The PC 1-8 in the service company and the management server 1-6 in the recycling plant receive the information regarding the kind of each unit (part) via network communication.

An example of the information provided is shown in FIG. 6A. The information includes the use information 601 input in step S12-1, a user ID 602 for identifying the user, and an image-forming apparatus ID 603 which is, for example, a MAC address of the image-forming apparatus (i.e., MFP device 1-1). The use corresponding to the image-forming apparatus or the user is set such that the image quality and the performance are emphasized. The information shown in FIG. 6A is stored in the database 1-7 via the management server 1-6.

When the user wishes to change the use of the image-forming apparatus, a request for changing the use information is transmitted to the management server 1-6 by setting change flag 604 to 1. When the management server 1-6 receives the request for changing the use information, it updates the use information stored in the database 1-7 in correspondence with the user or the image-forming apparatus on the basis of the received request. With respect to the user and the image-forming apparatus corresponding to the information provided in step S12-2, since the use information is stored in the database 1-7 in correspondence with the user ID and the image-forming apparatus ID, the use information to be updated can be determined by analyzing the user ID 602 and the image-forming apparatus ID shown in FIG. 6A.

Since the information, including the reuse level of each part, is transmitted in step S12-2, the user and the manager share this information. In addition, the MFP device 1-1 receives information shown in FIG. 6B, including the reuse level of each part, from the management server 1-6 or the PC 1-8 as a response, and stores the obtained information in a memory unit provided in the MFP device 1-1. The information provided from the management server 1-6 or the PC 1-8 is obtained as a result of calculation performed by the management server 1-6 or the PC 1-8. In particular, reuse levels corresponding to the specified uses are obtained by referring to a table showing the reuse level in correspondence with the kind information and the use information. Step S12-2 may be performed at any time. For example, either when the MFP device 1-1 is turned on, or it can be periodically scheduled.

Next, in step S12-3, the MFP device 1-1 checks the parts on the basis of the information obtained in step S12-2, and determines whether any part needs replacing. This determination is accomplished by checking each of the recyclable parts and confirming whether or the requirements on the MFP device 1-1, based on the information input in step S12-1, are satisfied. For example, when the image quality is required in step S12-1, it is determined whether the reuse levels of the recyclable parts related to the image quality are equal to or greater than their respective required levels. When the reuse level of a recyclable part related to the image quality is less than the required reuse level, it is determined that the part needs replacing. When the reuse level of a recyclable part related to the image quality is equal to or greater than the required reuse level, it is determined that the part does not need replacing.

If, in step S12-3, none of the recyclable parts needs replacing, the process returns to step S12-2 and the current information regarding the reuse levels is stored in the memory. If, in step S12-3, it is determined that there is a part that needs replacing in which the image quality is emphasized in step S12-3, flow proceeds to step S12-4, where the database 1-7 in the recycling plant is referred to and the information of the table in FIG. 6B is obtained. Since the information shown in FIG. 6B is referred to, double ordering can be prevented.

FIG. 6B shows a recycled-part request table set in the MFP device 1-1 in which the image quality and the performance are emphasized. According to FIG. 6B, in order to satisfy the user's requirements for the image quality, the reuse levels of a cartridge, a roller, a drum, and a scanner must be 7, 3, 6, and 9, respectively, or more. In addition, in order to satisfy the user's requirements for the performance, the reuse levels of the roller and a fan must be 8 and 5, respectively, or more. In the case in which a plurality of uses are set, the required reuse level is set to the highest level among the reuse levels set individually for each use. The table shown in FIG. 6B corresponds to the state in which the cartridge, the drum, and the fan are already ordered and the drum is delivered to the service company, but none of them are installed in the MFP device 1-1 yet.

Returning to FIG. 5, in step S12-5, it is determined whether a part that matches the requirements is available. The availability of the part is determined based on information obtained from the service company, the information showing whether or not a part which corresponds to the unit determined to be replaced in step S12-3 and which has a reuse level high enough for the use is stocked in the management environment. The information from the service company corresponds to the result of determination performed in step S14-11 of FIG. 7, which is described below. The determination performed in step S12-5 may also be performed in the service company (PC 1-8) having the information shown in FIG. 6B. In such a case, an order for the part is placed by the service company.

If, in step S12-5, there is no recycled part that satisfies the reuse level required for ensuring the image quality, then in step S12-6, an order for a new part is automatically placed on the PC 1-8 in the service company via the Internet. If, however, there is a recycled part that matches the requirements, then in step S12-7, automatic transfer of the recycled part from the recycling plant to the maintenance service company of the MFP device 1-1 is requested via the Internet. Step S12-7 corresponds to a confirmation performed in step S14-11 of FIG. 7, described below. The order may also be directly placed on the PC 1-8 in the service company without using the PC 1-6 in the recycling plant.

Then, in step S12-8, a service person brings the recycled part to the user environment and replaces the parts.

The steps of FIG. 5 may be performed by the PC 1-8 in the service company or by the management server 1-6 instead of the MFP device 1-1 or the PC 1-2 in the user environment. In such a case, the information used in steps S12-1 and S12-3 is transmitted to the PC 1-8, which serves as a server for extracting the information of the parts in the MFP device 1-1 part or to the management server 1-6 which has the reuse level information of recyclable parts.

8-2. Contents of Database Connected to Server in Recycling Plant

FIG. 6B shows the contents of the database 1-7 connected to the management server 1-6 in the recycling plant. The manner in which recyclable parts included in the MFP device 1-1 are selected using the contents of the database 1-7 will be described below. The table corresponds to the case in which the user emphasizes both the image quality and the performance.

In FIG. 6B, column "#" represents the serial number of the parts, column "name of part" represents the part name, column "model No." represents the model number of the part, and column "reuse level" represents the current reuse level of the part.

In the columns "required level (image quality)" and "required level (performance)", the symbol "○" is attached to items (reusable parts) selected by the reusable part provider 15-5 when the image quality and the performance are emphasized. The column "required level (image quality)" shows that the reuse levels of a cartridge, a roller, a drum, and a scanner must be 7, 3, 6, and 9, respectively, or more to ensure the image quality. Prior to the automatic transfer of a recycled part, the reusable part provider 15-5 compares the reuse level of each part that is selected and set in the table with the required level for the part shown in FIG.

6B. If there is a part whose reuse level is higher than the required level, that part is selected and transferred. Parts whose reuse levels are lower than the predetermined required level are not used for the MFP device 1-1 in which the image quality is emphasized, and a new part is ordered instead.

Similarly, when the performance is emphasized, the roller and the fan are selected, and parts whose reuse levels are lower than the predetermined required level are not used. FIG. 6B shows the case in which the user emphasizes both the image quality and the performance, and different required levels are set for each part. In the case in which the user emphasizes both the image quality and the performance, and a certain part is selected for both the image quality and the performance, the higher reuse level is set as the required reuse level. For example, with respect to the roller (#000002), the reuse level required for ensuring the image quality is 3 and the reuse level required for ensuring the performance is 8. Therefore, the reusable part provider 15-5 sets the required reuse level for the roller to 8.

The table shown in FIG. 6B includes data regarding whether an order for each part is already placed on the service company, whether a reusable part is already delivered to the service company, and whether the part is already installed in the image-forming apparatus (e.g., MFP device 1-1), and this data is used for managing the parts. Accordingly, parts with high levels are provided for the parts related to items emphasized by the user, and recycled parts are provided for the parts unrelated to the items, and therefore the cost is reduced.

8-3. Operation of Server in Recycling Plant

Figures 7A, 7B:
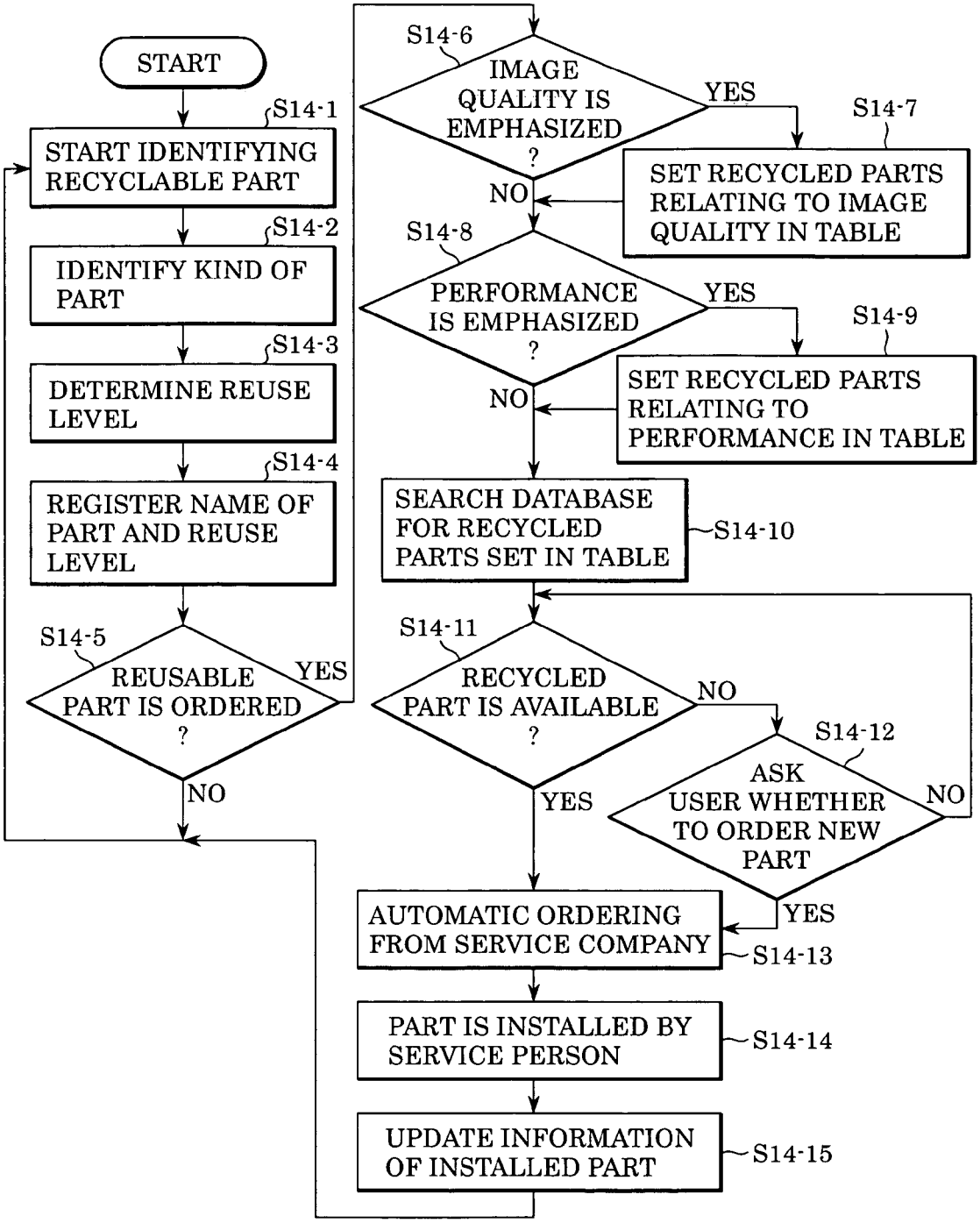
FIG. 7A is a flowchart of a process performed by a management server installed in a recycling plant.
FIG. 7B is an example of information regarding an order request transmitted from the MFP device to the management server.

FIG. 7A is a flowchart of a process in which information is stored in the recycled-part database 1-7 provided in the recycling plant, an order for a recycled part is placed by the MFP device 1-1 in the user environment, and the part is installed in the MFP device 1-1. A program corresponding to control steps shown in FIG. 7A is stored in a memory, such as a system memory, included in a computer which functions as the server. Each step in FIG. 7A is executed by a CPU which operates on the basis of the program.

First, in a sub-process of registering recyclable parts in the database 1-7, identification of a recyclable part obtained from a disassembled MFP device 1-1 is started by the unit identifier 15-1 in step S14-1. Next, in step S14-2, the unit identifier 15-1 identifies the kind of the part and determines whether the part corresponds to items such as the image quality, the performance, etc., on the basis of the table registered in the database 1-7 in advance. Then, the reuse level of the recyclable part identified in step S14-2 is determined by the reuse-level determiner 15-2 in step S14-3, and the information regarding the recyclable part is registered in the database 1-7 in step S14-4.

In step S14-5, it is determined whether an order for a recycled part of the same kind is placed. The order may be placed automatically by the MFP device 1-1 in the user environment, by the management server 1-6 in the service company which monitors the MFP device 1-1, or from the recycling plant which monitors the MFP device 1-1.

FIG. 7B shows an example of the information regarding an order request transmitted from the MFP device 1-1 to the management server 1-6. The information shown in FIG. 7B includes the user ID and the image-forming apparatus ID for determining the user and the image-forming apparatus from which the order request is transmitted and the names (IDs) of the parts that are requested.

The use information of parts for which the order request is transmitted is registered (stored) in the database 1-7 for each part in correspondence with the image-forming apparatus identified by the user ID and/or image-forming apparatus ID, and can be identified from the order request like the one shown in FIG. 7B. Accordingly, it is not necessary that the use information be included in the table shown in FIG. 7B.

Returning to FIG. 7A, when no order is placed in step S14-5, the process returns to step S14-1. When an order for a recycled part is placed in step S14-5, the reuse level of a unit to be provided is determined on the basis of the kind information (e.g., FIG. 7B) input from the MFP device 1-1 or the PC 1-8 via the Internet and the use information registered (stored) in the database 1-7 in correspondence with the user or the MFP device 1-1 from which the order is placed. The reuse level is determined by, for example, referring to a table showing the relationship between the kind of the unit, the use, and the reuse level, and reading out the reuse level corresponding to the kind of the unit and the use.

More specifically, the reusable part provider 15-5 determines whether the image quality is emphasized in the MFP device 1-1 belonging to the user in step S14-6. When the image quality is emphasized, reusable parts related to the image quality are checked in the table shown in FIG. 6B, and the symbol "○" and a required level are input in the column "required level (image quality)" for each part in the table shown in FIG. 6B in step S14-7. When the image quality is not emphasized, flow proceeds to step S14-8, where it is determined whether the performance is emphasized.

When the performance is emphasized, reusable parts related to the performance are checked in the table shown in FIG. 6B and the symbol "○" and the required level are input in the column "required level (performance)" in the table shown in FIG. 6B in step S14-9. When the performance is not emphasized, the process proceeds to step S14-10.

Parts with the symbol "○" attached in FIG. 6B are the reusable parts requested by the user, and the required level is set for each part. Accordingly, these parts are searched for in the database 1-7 in step S14-10, and whether a unit with the required reuse level and of the same kind as the part to be replaced is available is determined by searching the database 1-7.

Table 1 shows the manner in which the stock data of reusable parts is stored in correspondence with the reuse level in the database 1-7. In this table, the numbers of parts stocked are registered in correspondence with ID for identifying each part and the reuse level. The above-described group to which each part belongs is also set in the table. In addition, although not shown in the table, life information representing the remaining life is also registered for each part. A method for calculating the life will be described in detail below in a second embodiment. Whether or not there is a unit with the required reuse level is determined on the basis of the information registered in the database 1-7.

TABLE 1

| | | Number of Parts Stacked | | | |
|---|---|---|---|---|---|
| Name (Part ID) | Group | Level 1 | Level 2 | Level . . . | Level 10 |
| Cartridge | 1 | 21 | 59 | . . . | 26 |
| Drum | 1 | 15 | 61 | . . . | 7 |
| Scanner | 1 | 45 | 55 | . . . | 22 |
| Roller | 2 | 19 | 34 | . . . | 32 |
| Fan | 2 | 13 | 11 | . . . | 11 |
| . | . . . | . . . | . . . | . . . | . . . |
| . | . . . | . . . | . . . | . . . | . . . |
| . | . . . | . . . | . . . | . . . | . . . |

More specifically, when, for example, the MFP device 1-1 in the user environment requests only one recyclable part, such as a roller, a roller whose reuse level is 3 or more is searched for. Step S14-10 is executed by a searcher which searches for a unit with a reuse level that is determined in accordance with the kind of the reusable part (unit) being requested.

Returning to FIG. 7A, if a reusable part which satisfies the above requirements is found in the database 1-7 in step S14-11, an order for the reusable part is automatically placed on the service company in step S14-13 after a confirmation from the MFP device 1-1 in the user environment is received. If no reusable part which satisfies the above requirements is found in the database 1-7, a new part must be ordered.

Before ordering, the management server 1-6 asks for the user's permission to order an expensive new part in step S14-12. More specifically, an e-mail is sent to the user or a message is transmitted to the MFP device 1-1 belonging to the user via the Internet and displayed on the operation screen (not shown) of the MFP device 1-1. The user sends a reply indicating whether the order may or may not be placed via e-mail or by operating the MFP device 1-1, which transmits the reply via the Internet.

When the user's permission is obtained, an order for the new part is placed on the service company in step S14-13. If the user decides not to order the new part, the recyclable part is searched for again in step S14-11. When the service company receives the order, in step S14-14 a service person brings the part to the user environment to install it. Then, in step S14-15, the information of the database 1-7 is updated either automatically or by the service person. Steps S14-6 to S14-15 are performed by the reusable part provider 15-5, and these steps correspond to a sub-process of providing a unit with the required reuse level on the basis of the kind identified by the identifier.

According to the present embodiment, the reuse levels showing the states of recyclable parts among various parts included in the MFP device 1-1 are determined for each recyclable part in accordance with the kind thereof. Accordingly, the recyclable/reusable parts are efficiently managed on the basis of the determined reuse levels. For example, when the user emphasizes the image quality, the reuse levels of parts related to the image quality are set high so that parts with which the image quality is ensured are used in the image-forming apparatus. Similarly, when the user emphasizes the performance, parts with high reuse levels are used for those related to the performance so that the performance is ensured in the image-forming apparatus.

In addition, when the request shown in FIG. 6A is transmitted to or obtained by the management server 1-6, the management server 1-6 reads out the use information corresponding to the user or the MFP device 1-1 from the memory and determines the reuse level of a unit of the designated kind which is to be provided. Accordingly, an operator, for example, can visually check the determined reuse level on a display or the like, search the database 1-7 to see if a unit with the determined reuse level is stocked, and reply to the request from the user.

In addition, according to the present embodiment, the states of the parts included in the MFP device 1-1 in the user environment are communicated via the network, and the recycled parts required in the user environment are automatically ordered using the information of the recycled parts stored in the database 1-7 in the recycling plant. Accordingly, the time in which the MFP device 1-1 is used, although it is in poor condition, or the time in which the MFP device 1-1 cannot be used is reduced. In addition, the use of recycled parts is not only good for the environment, but also reduces the running cost for the user.

Second Embodiment

The hardware structure of the system according to a second embodiment and a part of the basic operations thereof are similar to those of the first embodiment, and thus the main characteristics of the second embodiment are described below.

9. Method for Obtaining Life of Recycled Part

Figures 15, 16:
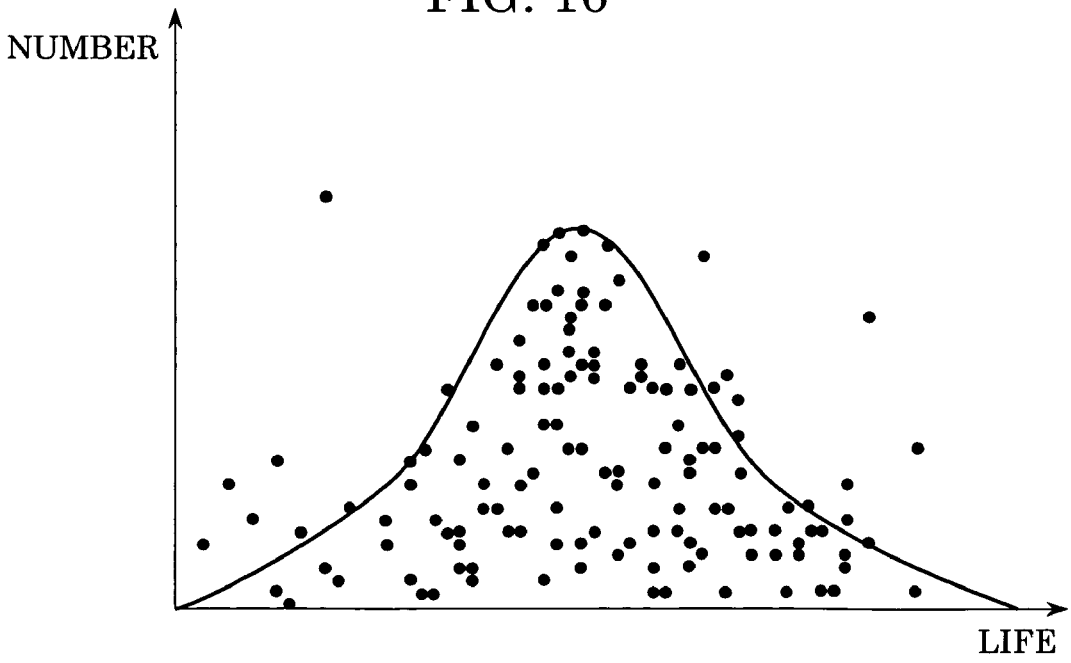
FIG. 15 is a table showing the relationship between the reuse level L and the life K of the recycled parts.
FIG. 16 is a graph showing the relationships between the life and number of recyclable parts in the standard deviation.

First, a method for determining the lives of recycled parts will be described. FIG. 13 shows the information of the recycled parts stored in the database 1-7. The lives of the parts set in FIG. 13 are easily derived from the respective reuse levels. FIG. 11 is a table showing the relationship between the recycle value Lt and the reuse level L, while FIG. 15 a table showing the relationship between the reuse level L and the life K of each recycled part. The table shown in FIG. 15 can be obtained from, for example, the table shown in FIG. 11. The tables shown in FIGS. 11 and 15 are obtained by setting thresholds for each part from experiment and experience, and are stored in the memory included in the MFP device 1-1.

The lives of the parts are transmitted from the MFP device 1-1 to the management server 1-6 in the recycling plant via the Internet. In addition, since the information regarding the lives of the parts is stored in the MFP device 1-1, the user and the service person can check the information and order the parts as necessary.

10. Central Control of Recyclable Parts in MFP Device

As described above in the first embodiment, FIG. 9 is a schematic diagram showing a system in which the CPU 47 manages the information of each of the recyclable parts included in the MFP device 1-1. The cumulative on-time since the fan was installed in the apparatus is stored at address 0004 because the on-time may serve as a factor for determining the life of the fan. Information representing the position of installation is stored at address 0005 because the life of the fan varies depending on the position at which the fan is installed. In addition, the information representing the rotational speed of the fan is stored at address 0006 because the maximum rotational speed differs for each fan and the life of the fan varies depending on the percentage of the rotational speed of the fan relative to the maximum rotational speed.

11. Schematic Structure of Recycling System

Figure 14:
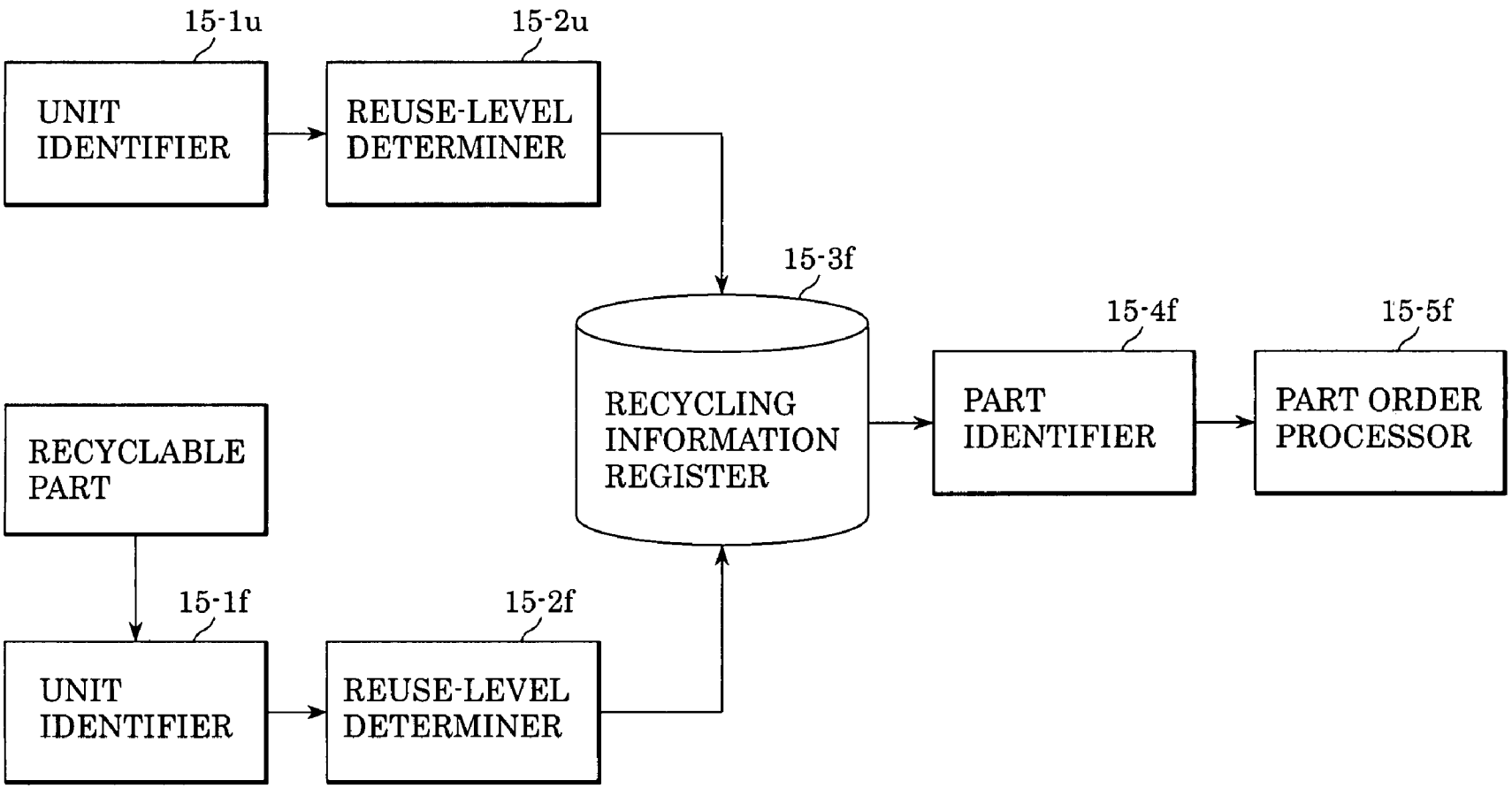
FIG. 14 is a block diagram showing a recycling system according to the present invention.

FIG. 14 is a schematic block diagram showing a recycling system according to the present embodiment. This system includes an information processor which selects parts to be provided such that the remaining lives of reusable parts included in the MFP device 1-1 are made uniform using a calculator which calculates the lives of the reusable parts.

The MFP device 1-1 in the user environment includes a unit identifier 15-1*u* which identifies the kinds of units included in the MFP device 1-1. More specifically, the kind of each part is determined by reading the name of the device stored at address 0001 and the name or model No. of the part stored at address 0002 or 0003, respectively, in the memory 49*a* shown in FIG. 9. In addition, a reuse-level determiner 15-2*u*, which is provided in the user environment, extracts the reuse levels calculated by the above-described reuse-level determining method and stored in the memory included in the MFP device 1-1. Functions of the unit identifier 15-1*u* and the reuse-level determiner 15-2*u* are carried out by executing a program stored in a memory, such as a system memory, with the CPU 47 included in the MFP device 1-1.

The obtained information is transmitted to, via the Internet, and registered in a recycling-information register 15-3*f* in the recycling plant. In addition, in the recycling plant, a unit identifier 15-1*f* and a reuse-level determiner 15-2*f* obtain the information regarding a recyclable part using one of the following three methods when the part is brought into the recycling plant. In a first method, the information of the part including the kind thereof is obtained from an RFID tag attached to each part. When the RFID tag is attached to each of the recyclable parts, the recycling information can be individually obtained from each part even when the part is taken out from the MFP device 1-1. This method is effective in the case in which the memory of the MFP device 1-1 cannot be accessed because of malfunction of the MFP device 1-1 or the like.

A second method is used when the MFP device 1-1 is a stand-alone apparatus which is not connected to the Internet. In this case, the information of each part is obtained from the information stored in the MFP device's 1-1 memory, and accordingly the kind and the reuse level of each unit can be obtained. A third method is used when the MFP device 1-1 is connected to the Internet. In this case, the identification No. of the MFP device 1-1 and the identification No. of each part included in the MFP device 1-1 is obtained from, for example, a memory (e.g., memory 49*b* of FIG. 9) included in the MFP device 1-1 via the Internet or by other means. Accordingly, the information of each part including the reuse level, the live, the use, etc., is obtained by referring to the management server 1-6 (recycling-information register 15-3*f*) in the recycling plant. In the present embodiment, the third method is used since the MFP device 1-1 installed in the user environment is connected to the Internet, and the information of each part is obtained via the Internet and registered in the database 1-7.

The recycling plant further includes a part identifier 15-4*f* which selects parts using an automatic part-selecting method, so as to make the remaining lives of the parts uniform. The recycling plant also includes a part order processor 15-5*f*, which automatically orders a recycled part when a part included in the MFP device 1-1 used in the user environment needs replacing because the remaining life thereof is short. Accordingly, the part selector 15-4*f* automatically selects an optimum recyclable part, and the part order processor 15-5*f* automatically places an order for the recyclable part. Functions of the unit identifier 15-1*f*, the reuse-level determiner 15-2*f*, the recycling-information register 15-3*f*, the part identifier 15-4*f*, and the part order processor 15-5*f* are carried out by executing a program stored in a memory, such as a system memory, with a computer included in the management server 1-6 in the recycling plant.

Figure 12:
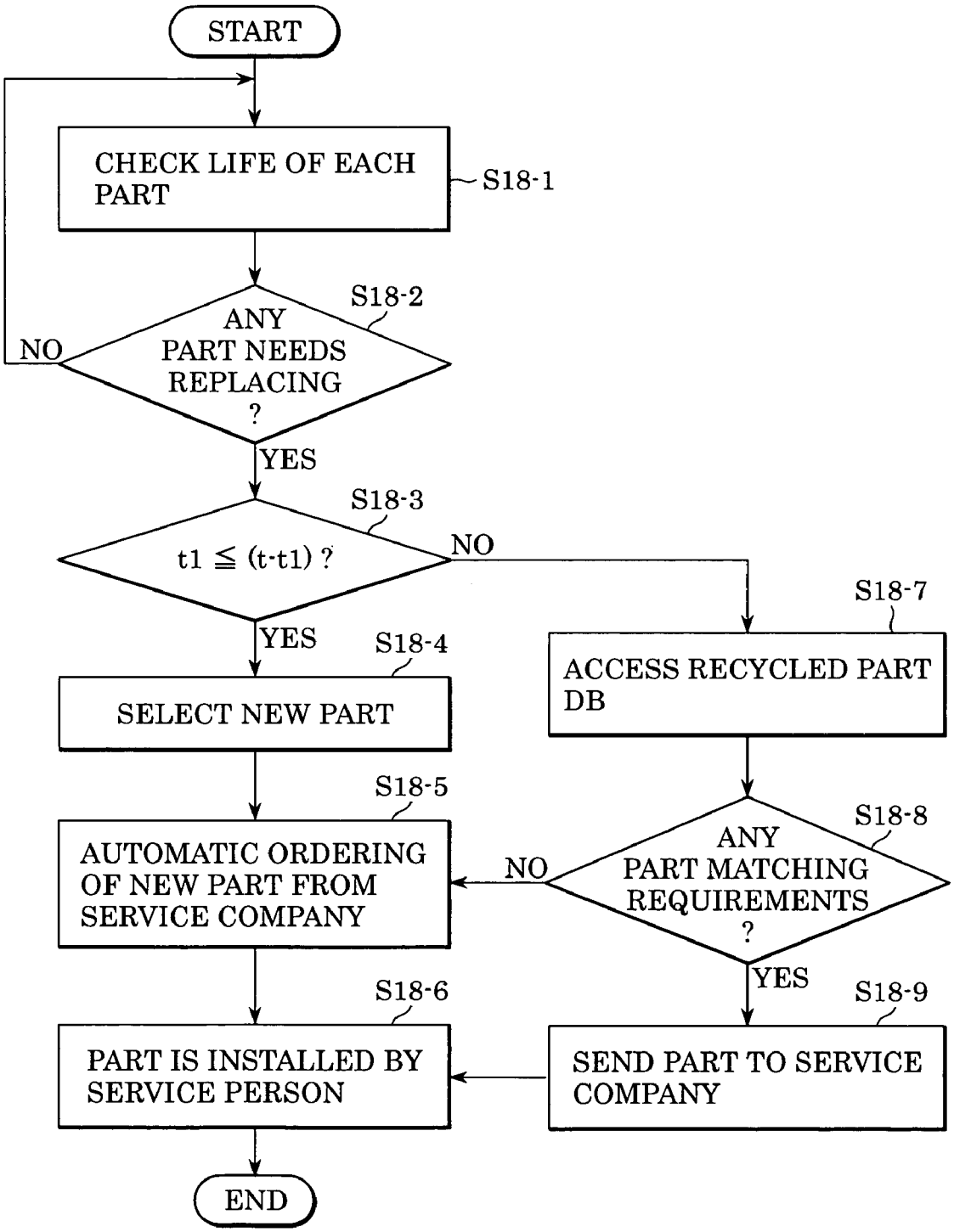
FIG. 12 is a flowchart of a process for making the remaining lives of parts uniform according to the present invention.
Figure 17:
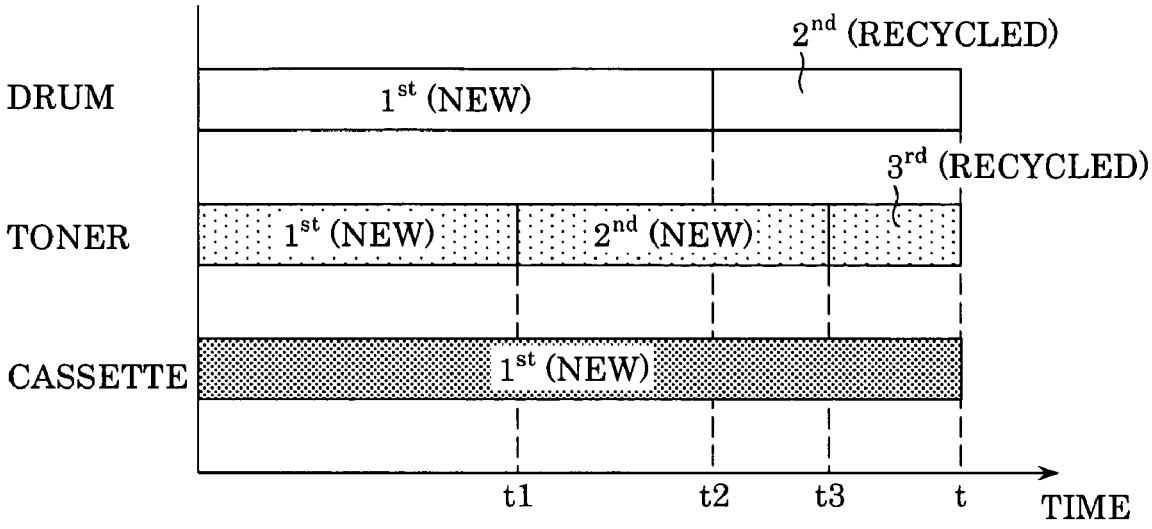
FIG. 17 is a diagram showing the lives of recycled parts and a uniform expiration time in time series.

Next, the part selector 15-4*f* in the recycling plant will be described below with reference to FIGS. 12 and 17. FIG. 12 is a flowchart of a process for making the remaining lives of the recycled parts uniform according to the present invention. FIG. 17 is a diagram showing the manner in which the recycled parts are used over time.

Turning to FIG. 17, the horizontal axis shows the lives of the parts and the vertical axis shows the kind of each part. In this example, the recycled parts are a drum, a toner cartridge, and a cassette in order from top to bottom. The cassette, which stores recording medium for the MFP device 1-1 has a relatively long life (t) since it is not a consumable part. It is understood from FIG. 17 that the drum requires replacement once and the toner cartridge requires replacement twice during the time t. The life of each part varies depending on various factors, and therefore the time for which a new part can be used is not always constant. However, for simplicity, it is presumed that a new part has a predetermined constant life and is worn at a constant rate.

In this case, the life of a first drum (new) which is initially installed in the MFP device 1-1 expires at time t2, and a recycled drum with a life of (t−t2) is used as a second drum. In addition, the life of a first toner cartridge (new) which is initially installed in the MFP device 1-1 expires at time t1, and the life of a second toner (new) expires at time t3. Then, a recycled toner cartridge with a life of (t−t3) is used as a third toner cartridge.

According to the present invention, the time t is set as a reference time for making the remaining lives of the parts in the MFP device 1-1 uniform. More specifically, parts are selected such that the lives thereof expire at time t, and accordingly the task of the service person who replaces the parts is reduced. The time t is changeable, and is hereafter called a uniform expiration time. The uniform expiration time t can be determined by various methods which provide different effects. Examples of the methods are:

a method using the longest life;
a method using the shortest life;
a method using the life of a reference part;
a method using the lives of parts near each other;
a method using the average life; and
a method using life distribution.

The effects provided by the above-mentioned methods are described below.

Method Using the Longest Life

FIG. 17 shows a method in which the uniform expiration time is set to the longest life among the lives of the parts included in the MFP device 1-1. Although the remaining lives of the parts cannot be made uniform immediately, they gradually become uniform by suitably using new parts and recycled parts in combination. Since the uniform expiration time is set to the longest life, new parts are repeatedly provided for some parts, such as the toner cartridge as shown in FIG. 17. The remaining lives of the parts are made uniform while the quality in the operation of the MFP device 1-1 is maintained.

Method Using the Shortest Life

Figure 18:
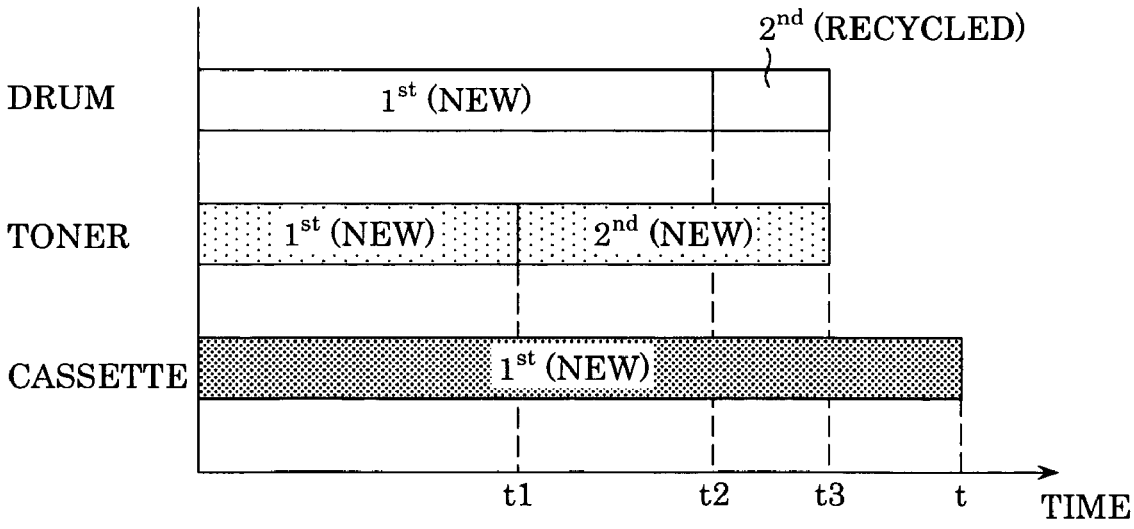
FIG. 18 is another diagram showing the lives of recycled parts and the uniform expiration time in time series.

FIG. 18 shows to a method in which the uniform expiration time is set to the shortest life among the lives of the parts included in the MFP device 1-1. Thus, instead of using the life t of a part like the cassette which can be used for an extremely long time, the uniform expiration time is set to a time (t1×2) based on the life of a part having the shortest time, like the toner cartridge shown in FIG. 18. When the life of a part, such as the drum, expires while the second toner cartridge is being used, a drum having the same remaining life as the second toner cartridge is selected as a second drum. Accordingly, when, for example, the MFP device 1-1 is leased or rented, the remaining lives of at least the parts having relatively short lives are made uniform. Since these parts are replaced when the MFP device 1-1 is collected and recycled, the task of recycling is reduced.

Method Using the Life of Reference Part

Figure 19:
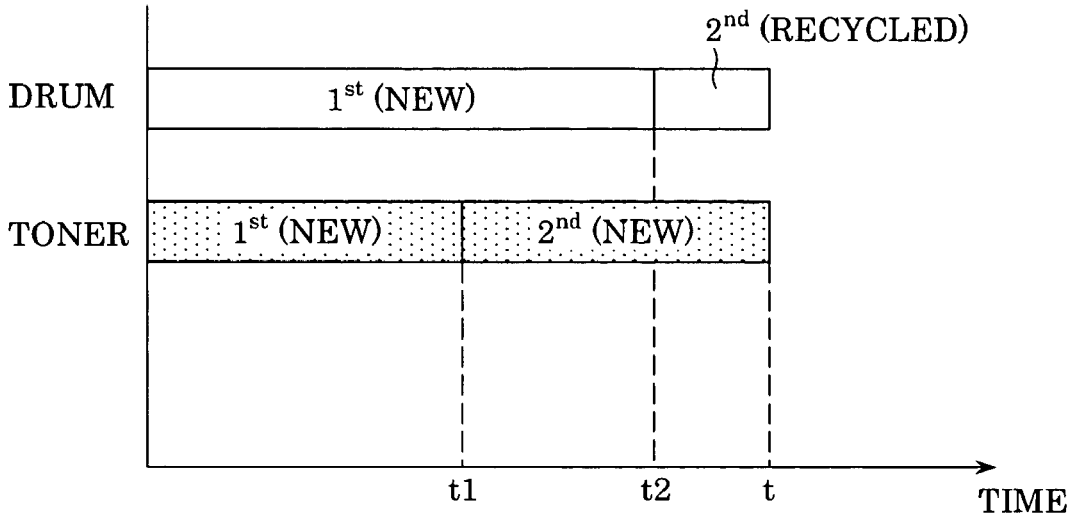
FIG. 19 is another diagram showing the lives of recycled parts and the uniform expiration time in time series.

FIG. 19 shows a method in which the uniform expiration time is set to the life of a reference part, and the remaining lives of parts related to the reference part are made uniform. The reference part may be selected randomly, or a part which wears out first may be set as the reference part. In FIG. 19, the reference part is the toner cartridge. Since the toner cartridge is related to the drum and is not related to the cassette, the life of the drum is adjusted to expire at the uniform expiration time (t1×2) set on the basis of the life of the toner cartridge. In general, parts related to one another affect a certain factor, such as the image quality, and defects which cannot be corrected simply by replacing only one part are often corrected by replacing the related parts together. Therefore, when, for example, the MFP device 1-1 is used by another user after the uniform expiration time, both the toner cartridge and the drum are replaced by new ones and the image quality is increased accordingly. This method is particularly advantageous when the first user prioritizes the performance over the image quality and the next user requires high image quality.

Method Using the Lives of Parts Near Each Other

Figure 20:
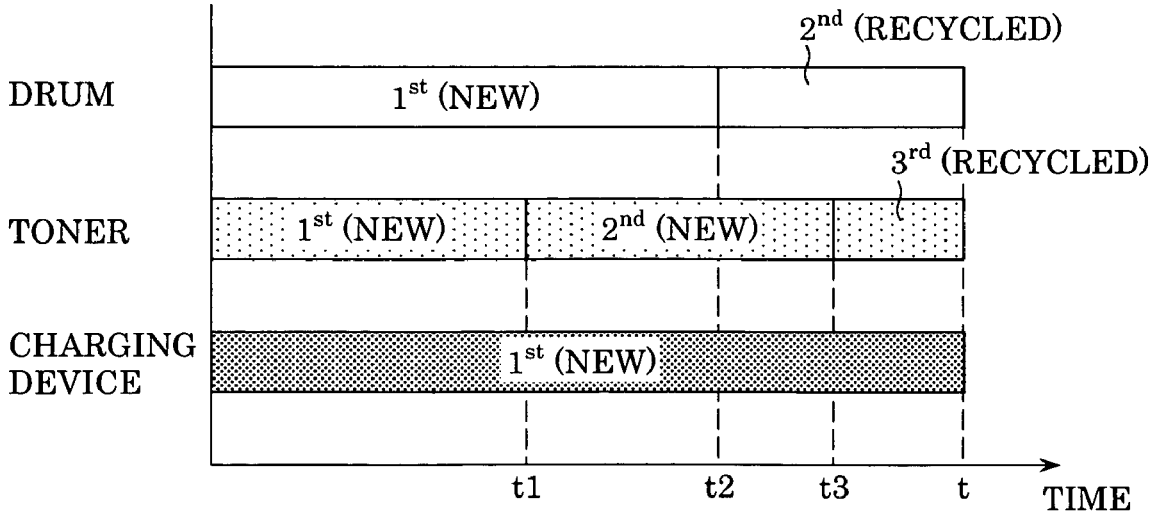
FIG. 20 is another diagram showing the lives of recycled parts and the uniform expiration time in time series.

FIG. 20 shows a method in which the uniform expiration time is set such that the remaining lives of parts disposed near each other are made uniform. According to this method, when a service person performs maintenance of the MFP device 1-1 in the user environment, the task of, for example, unscrewing bolts of the MFP device 1-1 is reduced since multiple parts can be replaced in a single visit. For example, in FIG. 20, the toner cartridge, the charging device, and the drum are positioned relatively near each other. Accordingly, the charging device is selected as a reference part and the uniform expiration time is set to the life t of the charging device. Therefore, when the charging device is replaced, the drum and the toner cartridge are also being replaced at the same time, and accordingly, the task of the service person is reduced.

Method Using the Average Life

Figure 21:
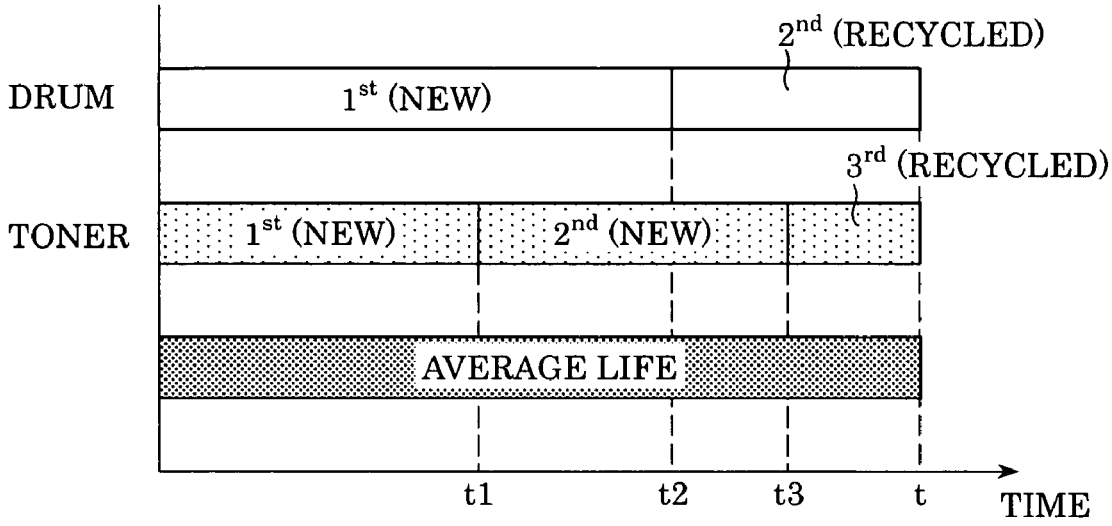
FIG. 21 is another diagram showing the lives of recycled parts and the uniform expiration time in time series.

FIG. 21 shows a method in which the uniform expiration time t is set to the average life of all of the recyclable parts included in the MFP device 1-1. In this case, after the remaining lives of the parts are made relatively uniform, the number of parts which can be replaced at the same time is further increased and the number of visits of the service person is further reduced.

Method Using Life Distribution

Figure 22:
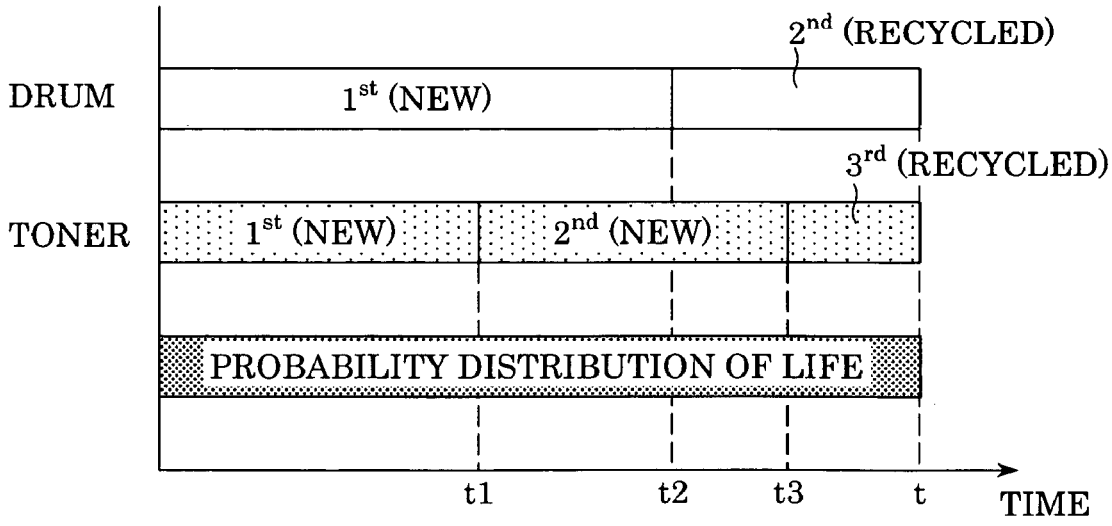
FIG. 22 is another diagram showing the lives of recycled parts and the uniform expiration time in time series.

FIG. 22 shows a method in which the uniform expiration time t is set to the probability distribution of the lives of all of the recyclable parts included in the MFP device 1-1. In this case, after the remaining lives of the parts are made relatively uniform to, the number of parts which can be replaced at the same time is further increased and the number of visits of the service person is further reduced. In addition, when the average life is used as described above, the uniform expiration time easily increases if some parts have extraordinary long lives like the cassette. FIG. 16 is a graph showing the relationship between the life of each recyclable part and the number of parts in the form of standard deviation. When the probability distribution (standard deviation) is used as shown in FIG. 16, the influence of parts having especially long lives like the cassette is reduced and the average of relatively short lives is obtained.

12. Operation of Server in Recycling Plant

Next, a method for adjusting the lives of the parts to expire at the uniform expiration time will be described below with reference to FIGS. 12 and 17. Steps S18-1 to S18-5 and S18-7 to S18-9 in FIG. 12 are carried out by executing a program stored in a memory, such as a system memory, with the computer which functions as the management server 1-6 in the recycling plant. An example in which the uniform expiration time is set to the life t of the cassette and the life of the drum is adjusted to expire at this time will be described below.

First, the lives of the parts included in the image-forming apparatus are checked in step S18-1. As described above, in the MFP device 1-1, the lives of the parts are constantly determined and the life information of each part is stored in the database 1-7 connected to the management server 1-6 in the recycling plant. Next, in step S18-2, it is determined whether any part of the MFP device 1-1 in the user environment needs replacing. If none of the recyclable parts needs replacing, the process returns to step S18-1.

If there is a part that needs replacing, flow proceeds to step S18-3, where it is determined whether t1<(t−t1) is satisfied. This expression is used for determining whether the time until the uniform expiration time is longer than the life of a new part. In other words, it is determined whether a new part can be used.

When the above-calculated time is longer than the life of a new part, then in step S18-4, the part selector 15-4*f* selects a new part, and the part order processor 15-5*f* places an order for the new part from the service company in step S18-5. If, however, in step S18-3, the above-calculated time is shorter than the life of a new part, flow proceeds to step S18-7, where the management server 1-6 searches for a part with a life of (t−t2) so that the life expires at the uniform expiration time t.

Next, in step S18-8, a determination is made whether a part with a life of (t−t2) is stocked in the recycling plant. If there is a part stocked in the recycling plant, then flow proceeds to step S18-9, where it is sent to service company, and the part is installed in the MFP device 1-1 by a service person in step S18-6. If no part that matches the requirements is found in step S18-8, then a new part is automatically ordered in step S18-5. The ordered new part is then installed by a service person in the MFP device 1-1 step S18-6.

13. Database in Server of Recycling Plant

Next, the part order processor 15-5*f*, which automatically transfers the recycled parts to the user environment, will be described with reference to FIG. 13.

FIG. 13 shows information regarding recycled parts which is stored in the database 1-7 connected to the management server 1-6 in the recycling plant. In the figure, "#" column represents the serial number of the parts, the "device ID No." column represents an identification number for the parts, the "name of part" column contains the name of the parts, the "model No." column contains the model number for the parts, the "position" column represents the position of the parts within the MFP device 1-1. The "reuse level", and "life" information are also included in the table.

The "order status" column shows whether an order is placed by the recycling plant in response to a request from the user, where the symbol "○" indicates the part has been ordered. The "delivery status" column shows whether or the part has been delivered to the service company, and the "installation" column shows whether or the part has been installed in the MFP device 1-1 in the user environment.

The database 1-7 not only stores the information regarding the stock of the recycled parts managed by the management server 1-6 in the recycling plant, but also the information used in an order management performed by the management server 1-6. For example, SO211i is registered as "device ID No." for part No. 000001, and the name of the device can be determined from this information. In addition, B-078 is registered as the "model No.", and 'cartridge' is registered as the "name of part" for part No. 000001.

In the above-described method in which the reference part is selected and the remaining lives of the related parts are adjusted, parts, for which codes similar to each other are set in "model No.", can be selected as parts which are related to each other. For example, model numbers like "B-XXX" are set for parts related to the cartridge, and these parts are determined as being related to each other. In another more specific example, C320-B2 is registered as "position" for part No. 000001 (cartridge). Since the drum (part No. 00003) has the same model number as the cartridge, is determined that the drum is relatively near the cartridge. Accordingly, in the above-described method in which the remaining lives of the parts near each other are adjusted, parts for which codes similar to each other are set in "position" can be considered as being near each other. With respect to installation positions, positions which are relatively near each other are denoted by the same number.

According to the present embodiment, when recyclable parts included in the MFP device 1-1 are replaced, parts to be provided are selected by taking into account the lives thereof so that the remaining lives of the parts included in the MFP device 1-1 are made uniform. Accordingly, the lives of the recyclable parts in the MFP device 1-1 expire at the same time, and the parts can be replaced at the same time. Therefore, the downtime of the MFP device 1-1 in the user environment and the task of the service person are reduced. In addition, when the MFP device 1-1 is disassembled in the recycling plant to obtain recyclable/reusable parts, a plurality of parts can be replaced or taken out at the same time when the remaining lives thereof are the same. Thus, the task of recycling is also reduced.

In addition, according to the present embodiment, the remaining life of a part to be replaced and those of parts near it are made uniform, so that the task of the service person or the task of recycling is reduced.

In addition, according to the present embodiment, the state in the MFP device 1-1 installed in the user environment can be obtained via a network, and the remaining lives are made uniform in each unit when the MFP device 1-1 is disassembled in the recycling plant. Accordingly, it is not necessary to disassemble each unit into smaller components, and a determination whether to discard or recycle a unit can be made immediately. Thus, the task of recycling is reduced. In addition, when the remaining lives of all of the parts included in the MFP device 1-1 are made uniform, the determination whether to discard the entire apparatus or to take out the parts from the apparatus for recycling can be made in advance. Accordingly, a situation where the apparatus is disassembled only to take out a single recyclable part can be avoided.

Recently, manufactures have been required to take the initiative in recycling activities, and the above-described reduction in the task of recycling leads to the promotion of the recycling activities. In addition, it is also advantageous for the user, since the downtime in which the MFP device 1-1 cannot be used is reduced. Also, the maintenance costs are reduced by using the recycled parts, and this motivates the user to use the recycled parts.

In the second embodiment, if the use of recycled parts is permitted by the user, recycled parts may also be selected such that the reuse levels thereof are equal to or higher than the required levels set in correspondence with items, such as the image quality and the performance, emphasized by the user. This is similar to the first embodiment.

As described in the above embodiments, the present invention provides a system for collectively managing recyclable parts for use in an MFP device 1-1 including units having individual specific characteristics. The present invention also provides a system for efficiently using recyclable/reusable items while satisfying requirements based on the use of the MFP device 1-1, which varies depending on the user. In addition, the present invention also provides a system for collectively managing recyclable/reusable parts such that the remaining lives of parts (components) included in the MFP device 1-1 are made uniform when the units having individual specific characteristics are replaced.

While the present invention has been described with reference to what are presently considered to be the embodiments, it is to be understood that the invention is not limited to the disclosed embodiments. On the contrary, the invention is intended to cover various modifications and equivalent arrangements included within the spirit and scope of the appended claims. The scope of the following claims is to be accorded the broadest interpretation so as to encompass all such modifications and equivalent structures and functions.

This application claims priority from Japanese Patent Application No. 2003-402204 filed Dec. 1, 2003, and Japanese Patent Application No. 2004-304735 filed Oct. 19, 2004, which are hereby incorporated by reference herein.

What is claimed is:

1. A recycling system which manages reusable units to be used in an image-forming apparatus including units, the recycling system comprising:

input means for inputting kind information of the units, the kind information being transmitted externally from the image-forming apparatus;

memory means for storing use information corresponding to the image-forming apparatus or a user of the image-forming apparatus; and determining means for determining a reuse level of a reusable unit to be provided on the basis of the kind information input from the input means and the use information stored in the memory means.

2. The recycling system according to claim 1, further comprising update means for receiving a request for changing the use information and updating the use information in the memory means on the basis of the request.

3. The recycling system according to claim 1, further comprising:

a database which stores stock information of the reusable units in correspondence with reuse levels; and searching means for searching the database to determine whether or not there is a reusable unit with the reuse level determined by the determining means.

4. The recycling system according to claim 1, further comprising:

evaluating means for evaluating whether or not there is a unit with a reuse level reduced to below a predetermined level in the image-forming apparatus, the predetermined level corresponding to the use of the image-forming apparatus; and ordering means for performing an ordering process on the basis of the result of evaluation performed by the evaluating means.

5. The recycling system according to claim 1, further comprising receiving means for receiving request data from the image-forming apparatus, the request data including an identifier for identifying the image-forming apparatus or the user and the kind of a unit, wherein the determining means determines the reuse level of the reusable unit to be provided to the image-forming apparatus on the basis of the use corresponding to the identifier and the kind of the unit included in the received data.

6. The recycling system according to claim 1, further comprising:

life calculating means for calculating the lives of the units included in the image-forming apparatus; and selecting means for selecting the reusable unit to be provided such that the life of the reusable unit expires at the same time as the life of one of the units included in the image-forming apparatus.

7. A method for managing reusable units to be used in an image-forming apparatus including units, the method comprising the steps of:

inputting kind information of the units, the kind information being transmitted externally from the image-forming apparatus;

storing use information corresponding to the image-forming apparatus or a user of the image-forming apparatus in memory means; and determining a reuse level of a reusable unit to be provided on the basis of the kind information input from the input means and the use information stored in the memory means.

8. The method according to claim 7, further comprising the step of receiving a request for changing the use information and updating the use information in the memory means on the basis of the request.

9. The method according to claim 7, further comprising the step of searching a database which stores stock information of the reusable units in correspondence with reuse levels and determining whether or not there is a reusable unit with the reuse level determined in the determining step.

10. The method according to claim 7, further comprising the steps of:

evaluating whether or not there is a unit with a reuse level reduced to below a predetermined level in the image-forming apparatus, the predetermined level corresponding to the use of the image-forming apparatus; and performing an ordering process on the basis of the result of evaluation performed in the evaluating step.

11. The method according to claim 7, further comprising the step of receiving request data from the image-forming apparatus, the request data including an identifier for identifying the image-forming apparatus or the user and the kind of a unit, wherein the reuse level of the reusable unit to be provided to the image-forming apparatus is determined on the basis of the use corresponding to the identifier and the kind of the unit included in the received data in the determining step.

12. The method according to claim 7, further comprising the steps of:

calculating the lives of the units included in the image-forming apparatus; and selecting the reusable unit to be provided such that the life of the reusable unit expires at the same time as the life of one of the units included in the image-forming apparatus.

* * * * *